US012110161B2

(12) United States Patent
Green et al.

(10) Patent No.: US 12,110,161 B2
(45) **Date of Patent: *Oct. 8, 2024**

(54) ROLLED PAPER PRODUCT CARGO ASSEMBLAGES AND METHOD FOR MAKING ROLLED PAPER PRODUCT CARGO ASSEMBLAGES

(71) Applicant: The Procter & Gamble Company, Cincinnati, OH (US)

(72) Inventors: Mark A. Green, Cincinnati, OH (US); Leo E. Taske, Okeana, OH (US); Scott M. Smith, Franklin, OH (US); Carlos O. Nilo, Cincinnati, OH (US); Kimberly M. Gerlach, Cincinnati, OH (US); Richard W. Hamm, Loveland, OH (US); Frederick Scott Britton, Cincinnati, OH (US); Arnaldo Vazquez Santiago, Madeira, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/305,404

(22) Filed: Apr. 24, 2023

(65) Prior Publication Data

US 2023/0257176 A1 Aug. 17, 2023

Related U.S. Application Data

(63) Continuation of application No. 17/669,414, filed on Feb. 11, 2022, now Pat. No. 11,667,446, which is a (Continued)

(51) Int. Cl.

| | |
|---|---|
| ***B65D 19/00*** | (2006.01) |
| ***B65D 71/00*** | (2006.01) |
| ***B65D 75/00*** | (2006.01) |

(52) U.S. Cl.
CPC ..... *B65D 71/0096* (2013.01); *B65D 75/006* (2013.01)

(58) Field of Classification Search
CPC ..... B65D 71/0096; B65D 71/0088; B65D 75/006; B65D 2571/00018
(Continued)

(56) References Cited

U.S. PATENT DOCUMENTS

| | | | |
|---|---|---|---|
| 3,788,462 | A | 1/1974 | Meincer |
| 4,036,364 | A | 7/1977 | Ambrose |

(Continued)

OTHER PUBLICATIONS

All Office Actions, U.S. Appl. No. 16/811,444, filed Mar. 6, 2020.

(Continued)

*Primary Examiner* — Luan K Bui
(74) *Attorney, Agent, or Firm* — Richard L. Alexander; Charles R. Matson

(57) ABSTRACT

Aspects of the present disclosure relate to cargo assemblages that may include containers of rolled products stacked on pallets secured thereto with film and methods of producing such cargo assemblages. The load may include containers of absorbent paper product arranged in stacked layers from a bottom layer of containers to a top layer of containers. A film may be applied to connect the load with the pallet and to connect neighboring stacked layers together. The film may be wrapped around the pallet and/or layers of containers with a wrap profile having different characteristics, such as for example, containment forces; tensions; numbers of layers, and/or locations of layers with respect to the load, the pallet, and/or each other.

22 Claims, 20 Drawing Sheets

Related U.S. Application Data continuation of application No. 16/811,444, filed on Mar. 6, 2020, now Pat. No. 11,279,539.

(60) Provisional application No. 62/815,382, filed on Mar. 8, 2019.

(58) Field of Classification Search
USPC ..... 206/386, 391, 394, 597, 600
See application file for complete search history.

(56) References Cited

U.S. PATENT DOCUMENTS

| | | | | |
|---|---|---|---|---|
| 4,136,501 | A | 1/1979 | Connolly | |
| 4,204,377 | A | 5/1980 | Lancaster et al. | |
| 4,206,846 | A * | 6/1980 | Connolly | B65B 11/045 383/117 |
| 4,235,062 | A | 11/1980 | Lancaster, III et al. | |
| 4,332,326 | A | 6/1982 | Kelly et al. | |
| 4,409,776 | A | 10/1983 | Usui | |
| 4,712,686 | A * | 12/1987 | Lancaster | A01F 15/071 206/597 |
| 4,741,442 | A | 5/1988 | Slocumb | |
| 4,747,252 | A | 5/1988 | Kapke | |
| 6,269,951 | B1 | 8/2001 | Hartwig | |
| 6,471,061 | B1 | 10/2002 | Teague et al. | |
| 9,550,589 | B2 | 1/2017 | Jäppi et al. | |
| 10,494,162 | B1 | 12/2019 | Jernigan | |
| 11,279,539 | B2 | 3/2022 | Green et al. | |
| 11,667,446 | B2 | 6/2023 | Green et al. | |
| 2003/0208994 | A1* | 11/2003 | Gooding | B65B 67/085 53/390 |
| 2008/0209862 | A1 | 9/2008 | Jappi et al. | |
| 2012/0205272 | A1* | 8/2012 | Heilman | B65B 25/146 206/391 |
| 2016/0272390 | A1* | 9/2016 | Dapper | B65D 71/066 |
| 2019/0300254 | A1 | 10/2019 | Tattam | |
| 2020/0283208 | A1 | 9/2020 | Green et al. | |
| 2021/0221584 | A1 | 7/2021 | Smith | |
| 2022/0161981 | A1 | 5/2022 | Green et al. | |
| 2023/0182982 | A1 | 6/2023 | Mcgrath | |
| 2023/0241777 | A1 | 8/2023 | Morris-downing | |
| 2023/0245036 | A1 | 8/2023 | Kuck | |
| 2024/0083650 | A1 | 3/2024 | Sanchez | |

OTHER PUBLICATIONS

All Office Actions; U.S. Appl. No. 17/669,414, filed Feb. 11, 2022.

* cited by examiner

ROLLED PAPER PRODUCT CARGO ASSEMBLAGES AND METHOD FOR MAKING ROLLED PAPER PRODUCT CARGO ASSEMBLAGES

CROSS REFERENCE TO RELATED APPLICATIONS

This application is a continuation of, and claims priority under 35 U.S.C. § 120 to, U.S. patent application Ser. No. 17/669,414, filed on Feb. 11, 2022, which is a continuation of U.S. patent application Ser. No. 16/811,444, filed on Mar. 6, 2020, now granted U.S. Pat. No. 11,279,539, issued Mar. 2, 2022, which claims the benefit, under 35 USC § 119(e), of U.S. Provisional Patent Application Ser. No. 62/815,382, filed on Mar. 8, 2019, the entire disclosures of which are fully incorporated by reference herein.

FIELD OF THE INVENTION

The present disclosure relates to cargo assemblages of loads secured on pallets with film, and more particularly, relates to cargo assemblages including containers of rolled paper products stacked on pallets and secured thereto with film.

BACKGROUND OF THE INVENTION

Rolled products, rolled absorbent products, and rolled fibrous products such as paper towels, toilet tissue, disposable shop towels, and wipes, for example, are sometimes packaged and shipped in bundles of a plurality of rolls. In some instances, the bundled packages may have two or more rolls stacked in a side-by-side fashion with another two or more rolls. In some configurations, individually wrapped packages of the two or more rolls, or stacks of rolls, may be packaged together into a larger "large count package." In some configurations, large count packages may contain a plurality of "naked" (i.e., unwrapped) rolls of product. The individually wrapped packages or naked rolls may be stacked or positioned together into a generally cuboid-shaped bundle and bound together with an overwrap.

Once rolled products are packaged, the packages of rolled products may then be arranged and stacked on pallets to be shipped. Pallets may have a square or rectangular shape and may be configured with various sizes. For example, some pallets may be about three feet to about four and a half feet long on each side. Some pallets may be configured to be moved by fork lifts. In addition, some pallets may sometimes also be used in retail stores for displaying the packages of rolled products to consumers. Once packages of rolled products are arranged on a pallet in a desired configuration, plastic film may be wrapped around the packages and the pallet to secure the packages to each other and to the pallet. The wrapped packages and pallets may then be moved to a shipping container, truck, or other type of shipping device that may transport the packages and pallets, for example, from manufacturers to distributers and/or consumers.

Some manufacturers may desire to ship greater amounts of products in smaller amounts of space in a relatively stable form providing convenient shipping and handling while reducing costs, waste, and the likelihood of damage caused to the products during shipping. To provide a relatively stable configuration for shipping, some packages may be arranged on the pallet to define a footprint that is substantially the same size as the pallet. However, in some instances, the sizes of the individual packages may result in an underhung or partially underhung arrangement on the pallet wherein the arranged packages define a footprint that is smaller than the size of the pallet. More particularly, an arrangement wherein a load of packages arranged on a pallet defines a perimeter that is smaller than a perimeter defined by the pallet, and wherein the perimeter of the pallet completely surrounds the perimeter of the load is referred to herein as an "underhung" arrangement. Further, an arrangement wherein a load of packages arranged on a pallet defines a portion of the perimeter that is smaller than a portion of a perimeter defined by the pallet, and wherein the perimeter of the pallet does not completely surround the perimeter of the load is referred to herein as a "partially underhung" arrangement. However, loads arranged on pallets in underhung or partially underhung arrangements may be relatively unstable and/or may have a tendency to shift on the pallet during shipping. For example, relatively tall loads having relatively small base footprints may have a relatively higher tendency to lean and/or fall over during shipping. In addition, when stacking underhung (or partially underhung) load/pallet arrangements on each other, upper pallets are not supported to the perimeter edges of the pallet by the load underneath, which results in a relatively less stable stacking arrangement that may be relatively more likely to lean and/or fall over during shipping. In turn, loads that fall over and/or shift during shipping can damage the rolled products, resulting in additional expenses and/or waste.

Additionally, the consumer continues to demand an assortment of rolled paper products, including rolled paper products having larger roll diameters. This creates a challenge for standard pallet sizes and creates scenarios where the package arrangements on a pallet are underhung or are partially underhung due to rolled paper products having different roll diameters on the same pallet and/or due to rolled paper products having particularly large roll diameters on the same pallet.

In order to overcome some of the problems associated with underhung or partially underhung arrangements, some suppliers may wrap the load and/or pallets with relatively thicker films and/or apply the films at relatively higher tensions. However, the use of relatively thicker films may result in added shipping costs and waste. In addition, wrapping loads with film at high tensions may increase the tendency of the film to rip or tear in locations, such as on the corners of the pallet. Further, highly tensioned films may also compress the upper levels of the load to define a smaller perimeter. In turn, the compressed upper levels of the load may allow the load to unintentionally penetrate or wedge into the spaces between supports on the bottom of a pallet stacked on the load.

Consequently, there remains a need to apply plastic film to secure packages of rolled products to each other and to pallets when configured in an underhung or partially underhung arrangement so as to reduce the quantities of film needed while at the same time increasing load stability during shipping.

DETAILED DESCRIPTION OF THE INVENTION

The following term explanations may be useful in understanding the present disclosure:

The term "machine direction" (MD) is used herein to refer to the direction of material flow through a process. In addition, relative placement and movement of material can be described as flowing in the machine direction through a process from upstream in the process to downstream in the process.

The term "cross direction" (CD) is used herein to refer to a direction that is generally perpendicular to the machine direction.

Aspects of the present disclosure relate to cargo assemblages of loads secured on pallets with film, and in particular, cargo assemblages including containers of rolled products stacked on pallets in an underhung or partially underhung configuration and secured thereto with film and methods of producing such cargo assemblages. As discussed in more detail below, a cargo assemblage may include a pallet and a load positioned on the pallet. The load may include containers of absorbent paper product, wherein the containers are arranged in stacked layers from a bottom layer of containers to a top layer of containers. The load and the pallet are sized such that the load defines a footprint that is smaller than a footprint of the pallet to create an underhung or partially underhung configuration. For example, the pallet may define a first perimeter. And the load may include a bottom surface and a top surface, wherein the bottom surface defines a second perimeter smaller than the first perimeter. The bottom surface of the load is positioned on the pallet such that the second perimeter of the bottom surface is completely surrounded by the first perimeter of the pallet. A film is applied to connect the load with the pallet and to connect neighboring stacked layers together. As discussed in more detail below, the film is wrapped around the pallet and/or layers of containers with a wrap profile that may be defined by a plurality of layers of film. The plurality of layers of film may be applied to have different characteristics, such as for example, containment forces; tensions; numbers of layers, and/or locations with respect to the load, the pallet, and/or each other.

Figure 1B:
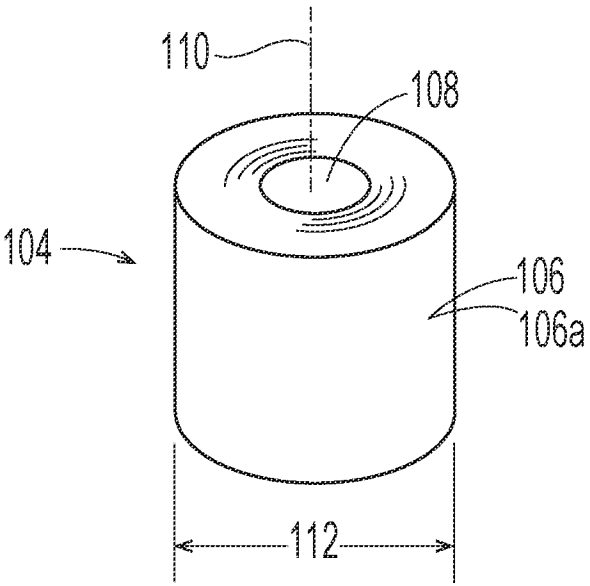
FIG. 1B is a simplified perspective view of a rolled paper product.
Figure 1A:
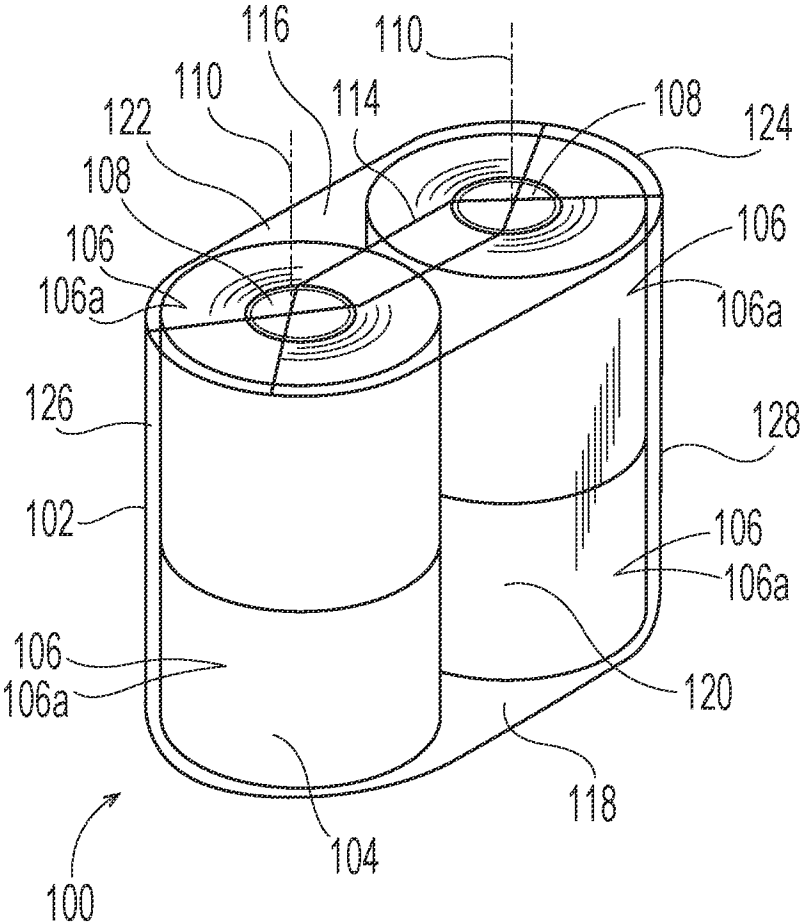
FIG. 1A is a simplified perspective view of a package including a container of absorbent paper product.

As previously mentioned, the cargo assemblages and methods of making such cargo assemblages discussed herein include a load positioned on a pallet, wherein film is wrapped around the load and/or pallet with a wrap profile. It is to be appreciated that the load may include packages of various types of products. For example, FIG. 1A shows a simplified perspective illustration of a package 100 that may include a container 102 of absorbent paper product 104. As shown in FIG. 1B, the absorbent paper product 104 may be configured as rolled paper product 106, rolled product, rolls of product, and/or rolls. "Rolled products" or "rolled paper products" or "rolls of product" or "rolls" within the present disclosure may include products made from cellulose fibers, nonwoven fibers, other suitable fibers, and combinations thereof. In some configurations, rolled products can be made of, or partially made of recycled fibers. Disposable rolled products or disposable rolled absorbent products or disposable rolled paper products may comprise paper towels, facial tissues, toilet tissues, shop towels, wipes, and the like, which may be made from one or more webs of fibers, such as cellulose fibers or nonwoven fibers, for example. Rolled paper products may comprises an absorbent towel substrate, a sanitary tissue substrate, or a cellulosic fiber containing substrate. With continued reference to FIG. 1B, each roll 106*a* of rolled paper product 106 may be wound about a paper, cardboard, paperboard, or corrugate tube to form a core 108 through each roll 106*a*. Each core 108 may define a longitudinal axis 110 extending therethrough. In some configurations, the rolls 106*a* of rolled paper product 106 may not include the paper, cardboard, paperboard, or corrugate tube, but instead, the rolls of product may be wound about itself to form a roll while still forming a core defined through each roll. The void area in the center of each roll where the product winds about itself can be considered a "core" for purposes of this disclosure, although such rolls may be referred to as "coreless" rolls.

It is to be appreciated that rolled paper products 106 herein may be provided in various different sizes, and may comprise various different roll diameters 112. For example, in some configurations, the roll diameter 112 of the rolled paper product 106 may be from about 4 inches to about 8 inches, or from about 5 inches to about 8 inches, or from about 6 inches to about 8 inches, specifically reciting all 0.5 inch increments within the above-recited ranges and all ranges formed therein or thereby. In some configurations, the roll diameter 112 of the rolled paper product 106 may be from about 6 inches to about 14 inches, or from about 7 inches to about 14 inches, or from about 8 inches to about 14 inches, specifically reciting all 0.5 inch increments within the above-recited ranges and all ranges formed therein or thereby.

Further, in some configurations, the roll diameter 112 of the rolled paper product 106 may be from about 8 inches to about 25 inches, or from about 9 inches to about 25 inches, or from about 10 inches to about 25 inches, specifically reciting all 0.5 inch increments within the above-recited ranges and all ranges formed therein or thereby.

It is also to be appreciated that the rolled paper product 106 may comprise various different roll densities, which may be measured according to the Roll Density Test Method described herein. For example, in some configurations, the rolled paper product 106 may comprise a roll density greater than or equal to about 0.03 g/cm$^3$ and less than or equal to about 0.32 g/cm$^3$, specifically reciting all 0.01 g/cm$^3$ increments within the above-recited ranges and all ranges formed therein or thereby. In some configurations, the rolled paper product 106 may comprise a roll density greater than or equal to about 0.05 g/cm$^3$ and less than or equal to about 0.20 g/cm$^3$, specifically reciting all 0.01 g/cm$^3$ increments within the above-recited ranges and all ranges formed therein or thereby.

The containers 102 that house the absorbent paper product 104 may be formed from various types of material and may be configured in various shapes and sizes. In some configurations, the containers 102 may be formed from a poly film material that may comprise polymeric films, polypropylene films, and/or polyethylene films. In some configurations, the containers 102 may be formed from cellulose, such as for example, in the form of paper and/or cardboard. The container 102 may have a preformed shape into which absorbent paper products 104 are inserted and/or may be formed by wrapping a material around one or more absorbent paper products 104 to define a shape that conforms with the shapes of individual products and/or arrangements of products. As shown in FIG. 1A, the container 102 may also include a seal 114, such as an envelope seal, for example, formed thereon. As shown in FIG. 1A, the container 102 may include a top side 116 and a bottom side 118. The container may also include a front panel 120 and a rear panel 122, wherein the front and rear panels 120, 122 are connected with and separated by opposing first and second sides 124, 126. The front panel 120, the rear panel 122, the first side 124, and/or the second side 126 may be substantially planar, curved, or convex as shown in FIG. 1A and may also define an outer surface 128 of the container 102.

Figure 1D:
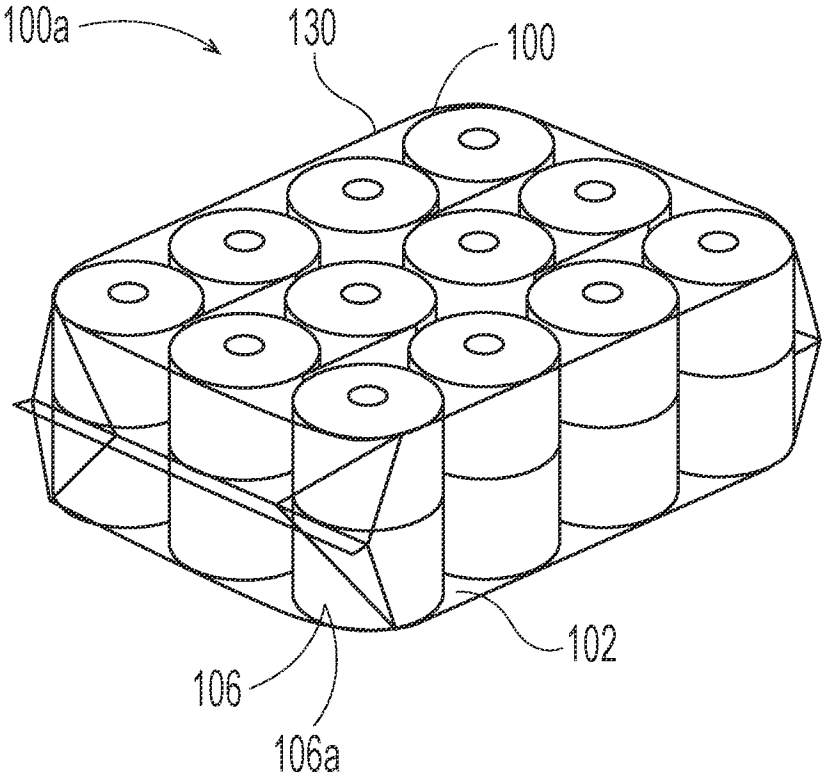
FIG. 1D is a simplified perspective view of a large count package including individually wrapped packages of absorbent paper product.
Figure 1C:
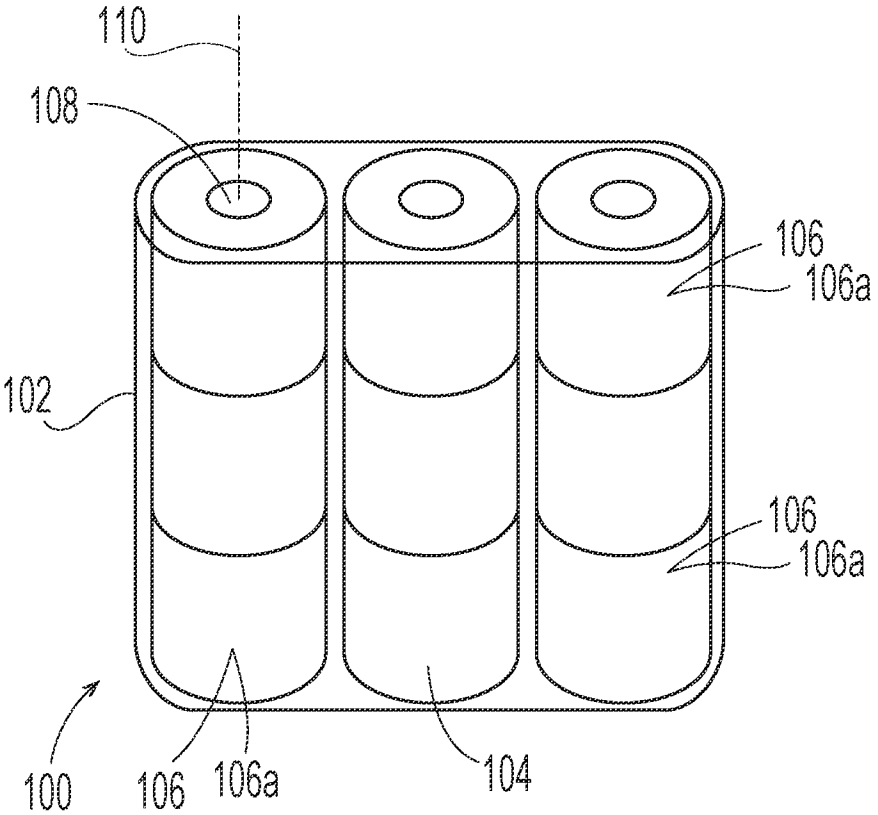
FIG. 1C is a simplified perspective view of a second package including a container of absorbent paper product.

It is to be appreciated that the packages 100 may include various quantities of absorbent paper products 104 that may be arranged in various orientations within the containers 102. For example, as shown in FIG. 1A, an individually wrapped package 100 may include four rolls of rolled paper product 106 inside a container 102, wherein two rolls 106*a* are stacked on another two rolls 106*a*. The longitudinal axis 110 of each of the cores 108 of each stack of at least two rolls 106*a* may be generally parallel and aligned with each other and adjacent stack(s) of at least two rolls 106*a* can lie in generally the same plane as the other stack(s) of at least two rolled paper products 106. In another example, shown in FIG. 1C, an individually wrapped package 100 may include nine rolls 106*a* of rolled paper product 106 arranged in stacks inside the container 102. It is to be appreciated that multiple rolls 106*a* of rolled paper product 106 can be enclosed in a container 102 constructed from a polymer film or other suitable material that may be sealed to form individually wrapped packages 100. In some configurations, individually wrapped packages 100 of the two or more rolls 106*a*, or stacks of rolls 106*a*, may be bundled and/or bound together within an overwrap 130 forming a container 102 to define a large count package 100*a*, such as shown in FIG. 1D. In some configurations, large count packages 100*a* may contain a plurality of "naked," (i.e., unwrapped) rolls 106*a* of rolled paper product 106. In some configurations, the individually wrapped packages or naked rolls may be stacked or positioned together into a generally cuboid-shaped container 102, such as disclosed in U.S. Patent Publication No. 2012/0205272 A1, which is incorporated by reference herein. It is to be appreciated that packages 100 can each comprise one or more rolls 106*a* of rolled paper product 106, such as for example, two, three, four, six, eight, nine, ten, twelve, or fifteen rolls of rolled paper product.

Figure 2:
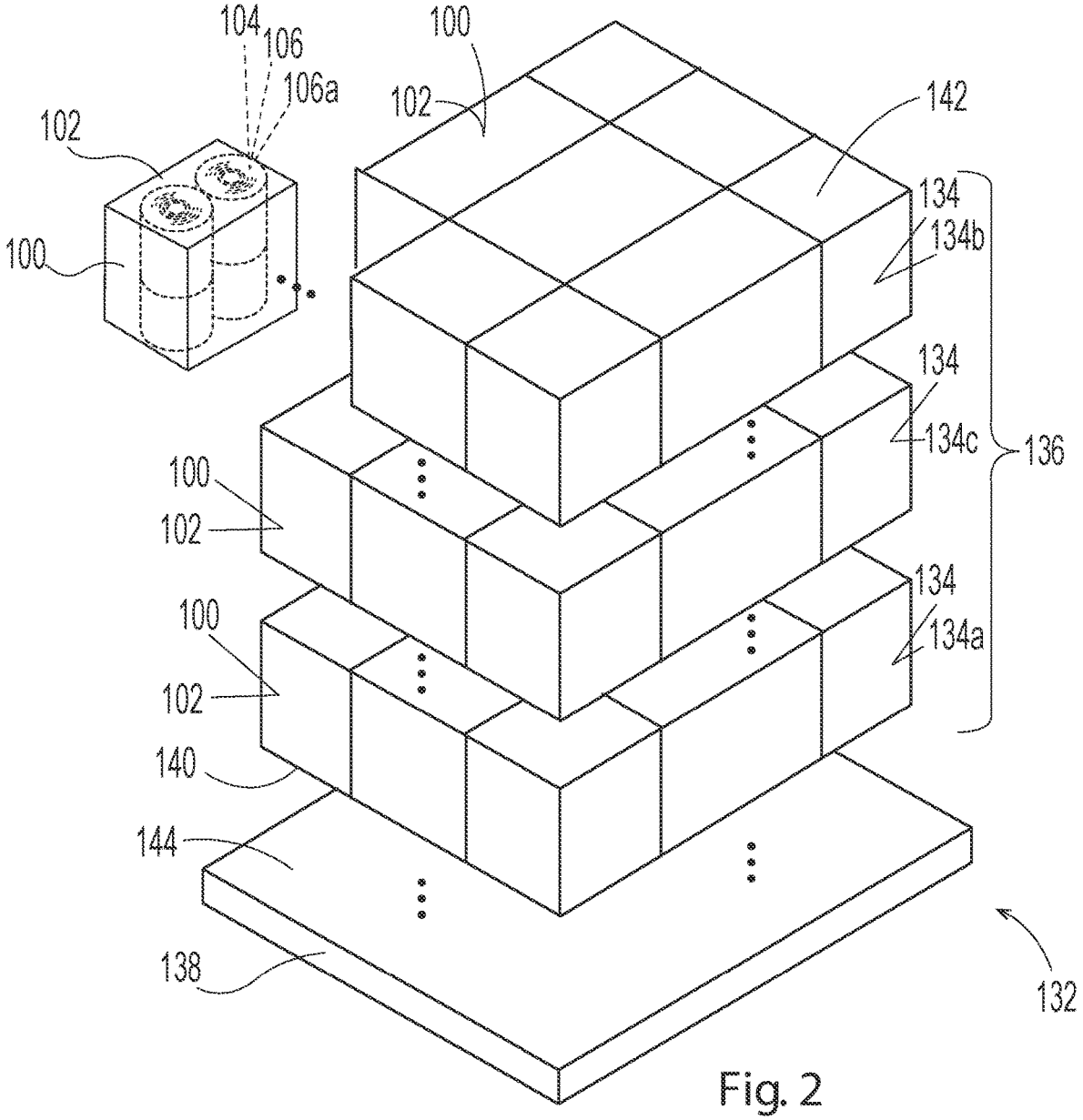
FIG. 2 is an exploded perspective view of a load arranged on a pallet, wherein the load is defined by layers of containers of absorbent paper product.
Figure 3A:
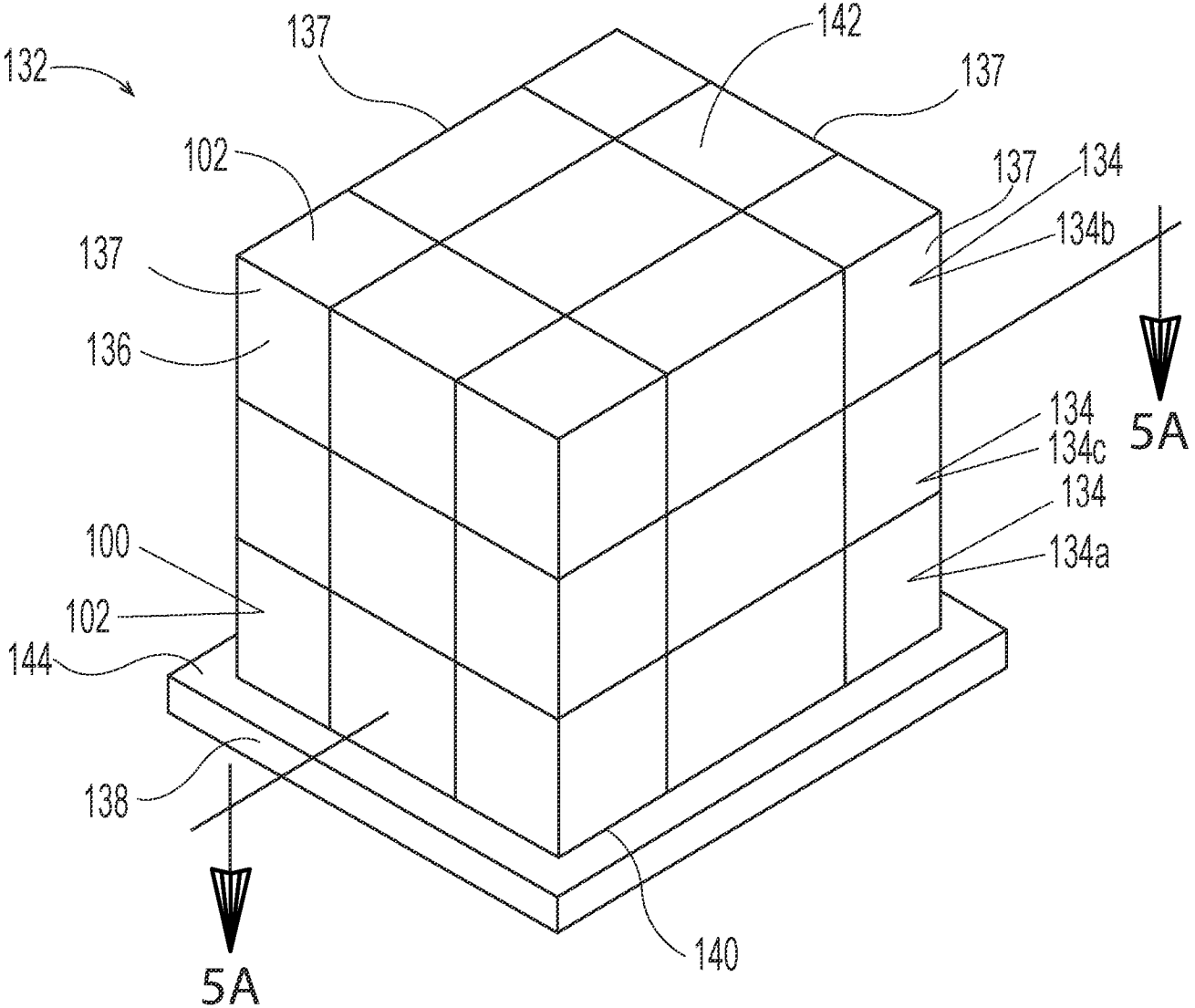
FIG. 3A is a perspective view of a load arranged on a pallet, wherein the load is defined by stacked layers of absorbent paper product.
Figure 3B:
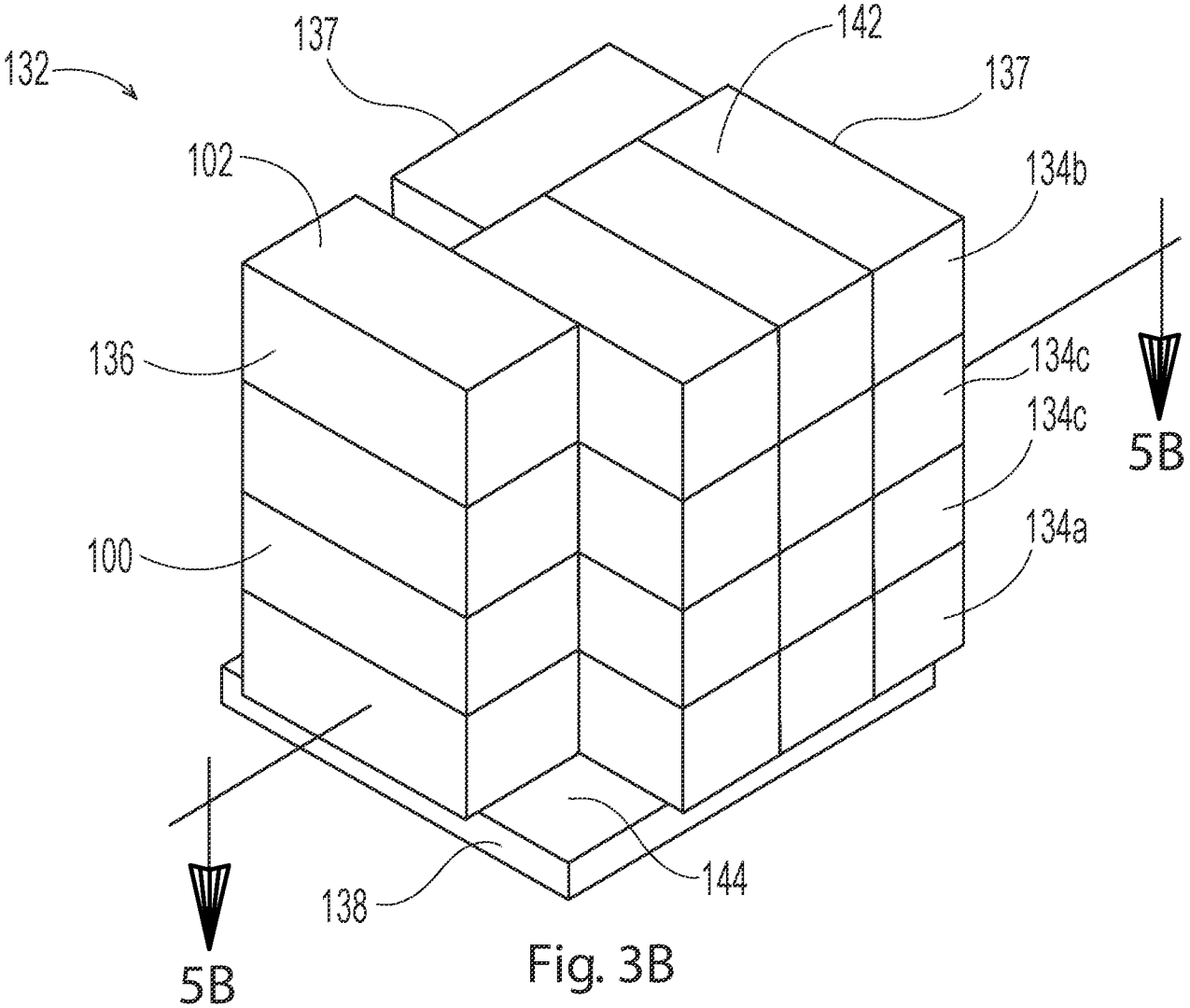
FIG. 3B is a perspective view of a load arranged on a pallet, wherein the load is defined by stacked layers of absorbent paper product.
Figure 3C:
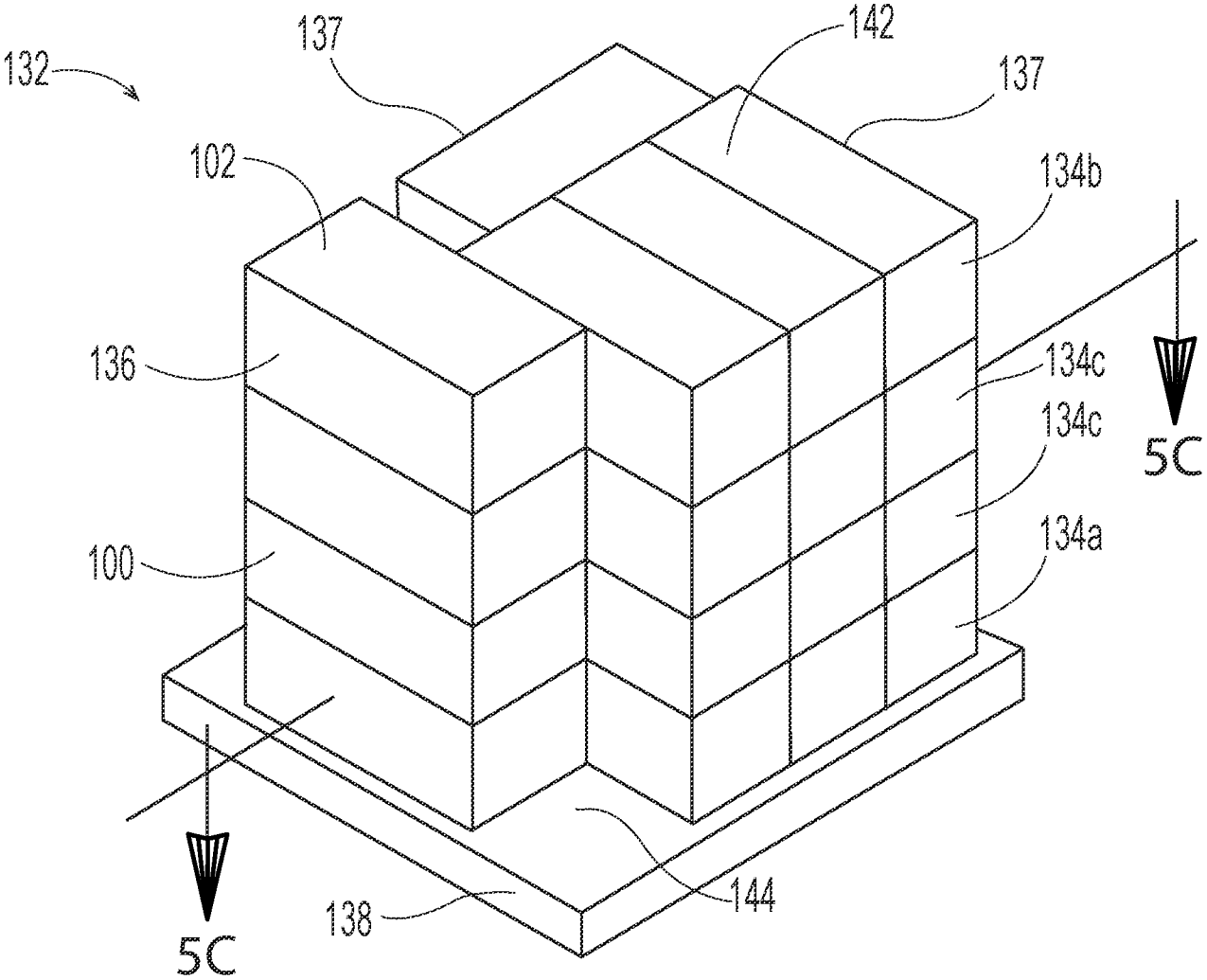
FIG. 3C is a perspective view of a load arranged on a pallet, wherein the load is defined by stacked layers of absorbent paper product.
Figure 3D:
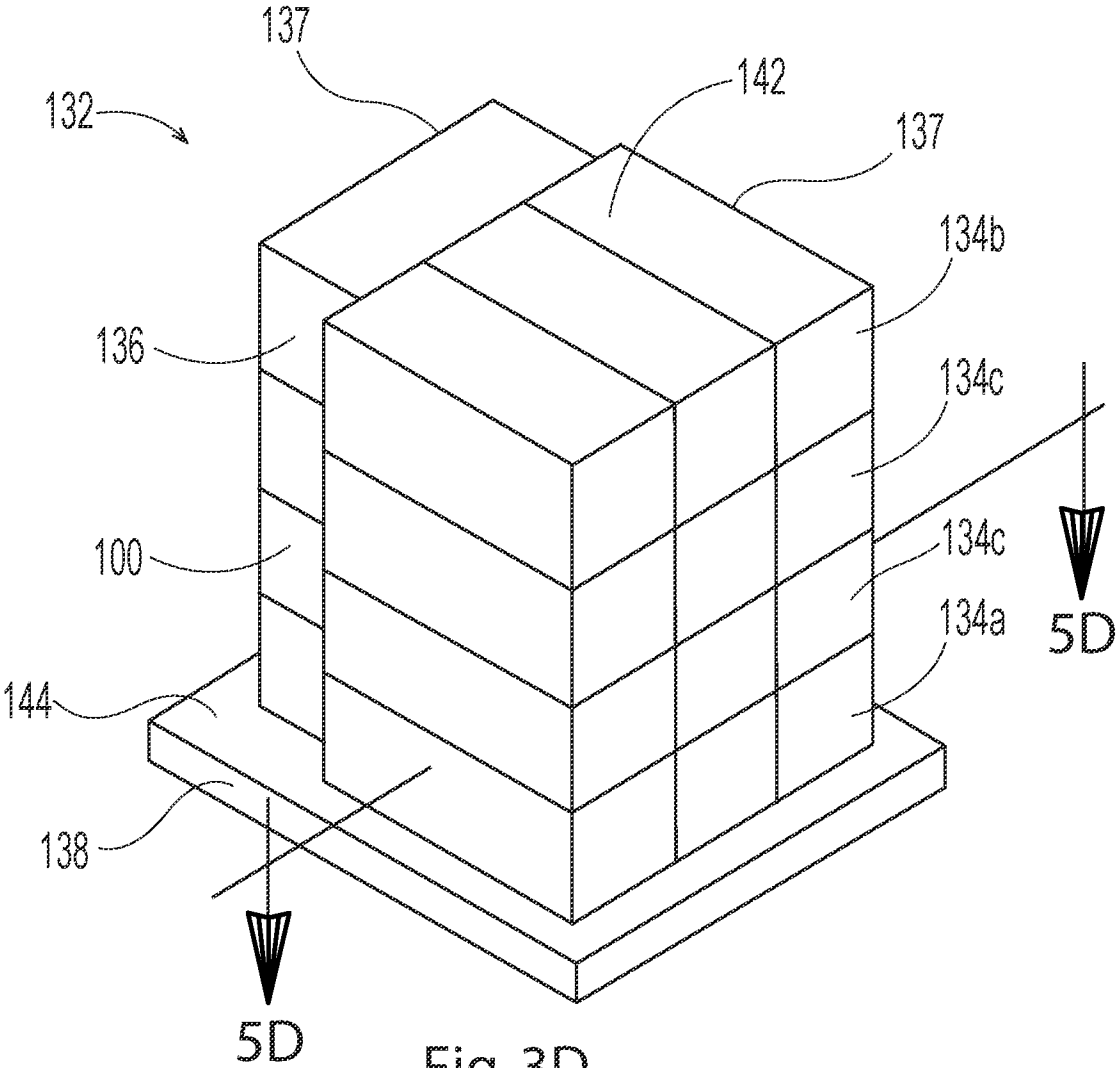
FIG. 3D is a perspective view of a load arranged on a pallet, wherein the load is defined by stacked layers of absorbent paper product.
Figure 4:
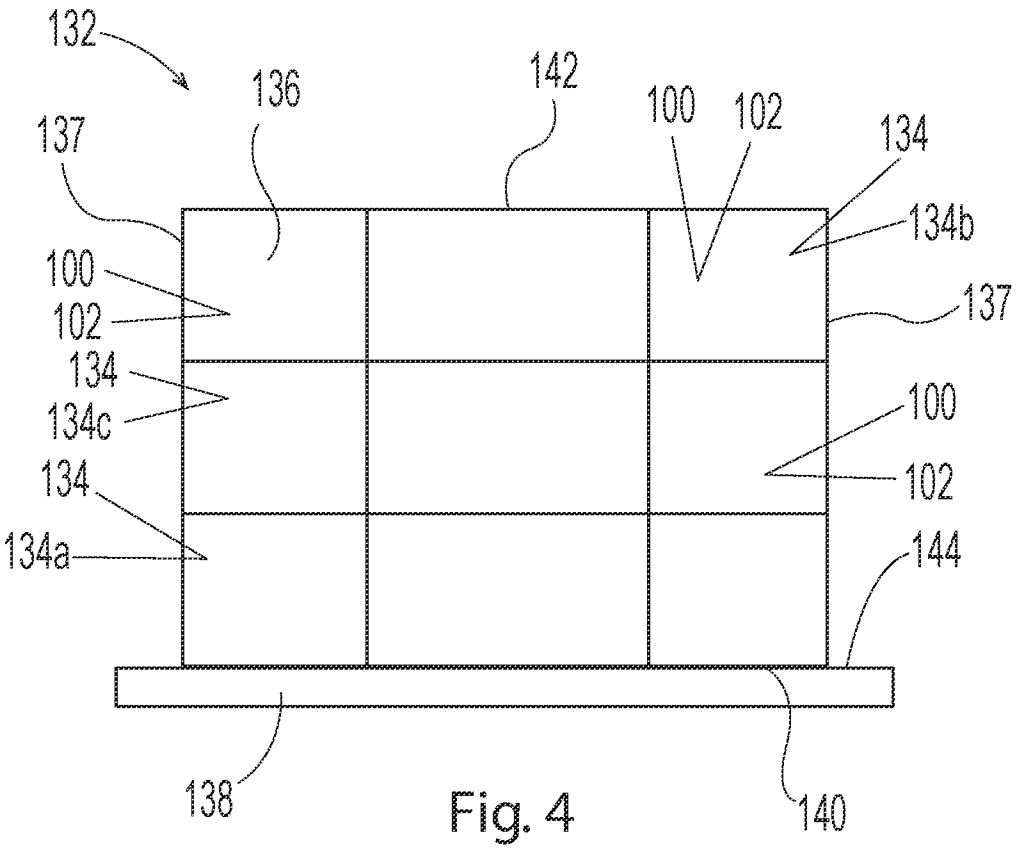
FIG. 4 is a front side view of the load and pallet from FIG. 3A.

Referring now to FIGS. 2-4, a cargo assemblage 132 may include packages 100, which may include containers 102 of absorbent paper product 104, arranged in layers 134 that are stacked to define a load 136 that may be positioned on a pallet 138. It is to be appreciated that pallets of various types and/or sizes may be used. Some pallets may be designed to be moved by fork lifts and may be rectangular-shaped. Some pallets may be configured as standard pallets of a type specified by the Grocery Manufacturers Association (GMA) and/or provided by CHEP Equipment Pooling Systems, Orlando, Fla. In some configurations, pallets may be configured with rectangularly shaped decks having a length of 48 inches and a width of 40 inches.

With continued reference to FIGS. 2-4, each layer 134 of the load 136 may include various numbers of containers 102 of absorbent paper product 104 arranged in various configurations. Although the packages 100 of absorbent paper product 104 are sometimes illustrated herein as having containers 102 with a generically cuboid shape, it is to be appreciated that the containers 102 illustrated in the accompanying figures may have various different sizes and shapes as described herein. It is also to be appreciated that the load 136 may also include various numbers of layers 134 of containers 102 of absorbent paper product 104. In some configurations, the load 136 may include a bottom layer 134*a* and a top layer 134*b*. In some configurations, the load 136 may include one or more layers 134*c* of containers 102 positioned between the top layer 134*b* and the bottom layer 134*a* of containers 102. As shown in FIGS. 2-5D, the load 136 may include a bottom surface 140 defined by the bottom layer 134*a* of containers 102 and a top surface 142 defined by the top layer 134*b* of containers 102. As such, the load 136 may define one or more sides 137 that extend upward from the bottom surface 140 to the top surface 142.

With continued reference to FIGS. 3A-5D, the load may be arranged such that the bottom surface 140 of the load 136 is positioned on the pallet 138 in an underhung or partially underhung arrangement. As such, the pallet 138 may define a first perimeter P1, and the bottom surface 140 of the load 136 may define a second perimeter P2 that is smaller than the first perimeter P1 of the pallet 138. In addition, the first perimeter P1 of the pallet 138 may completely surround the second perimeter P2 of the load 136. It is to be appreciated that the first perimeter P1 of the pallet 138 may be of various factors larger than the second perimeter P2 of the bottom surface 140 of the load 136. For example, in some configurations, a ratio of the first perimeter P1 to the second perimeter P2 may be greater than 1:1 and less than or equal to about 1.4:1. As shown in FIG. 5A, in some configurations, the load 136 may define a width $W_L$ and a length $L_L$, and the pallet 138 may define a width $W_P$ and a length $L_P$, wherein the width $W_P$ and/or the length $L_P$ of the pallet 138 may be longer than the width $W_L$ and/or the length $L_L$ of the load 136. In some configurations, the width $W_P$ and the length $L_P$ of the pallet 138 may be the same or different from each other, and the width $W_L$ and the length $L_L$ of the load 136 may be the same of different from each other. As shown in FIGS. 3A-5D, the pallet 138 may include a support deck 144, wherein the bottom surface 140 of the load 136 is positioned on the support deck 144. In some configurations, the support deck 144 may define a first area A1, and the bottom surface 140 of the load 136 may define a second area A2 smaller (at least in some portions) than the first area A1. It is to be appreciated that the support deck 144 may configured in various ways, such as for example, a contiguous surface or a discontinuous surface defined by an arrangement of spaced apart slats. When the second perimeter P2 is a square or a rectangle (see FIG. 5A), it may be referred to as a "symmetrical perimeter" or as "symmetrical." When the second perimeter P2 is a shape other than a square or a rectangle (see FIGS. 5B-D), it may be referred to as an "asymmetrical perimeter" or as "asymmetrical."

Figure 5A:
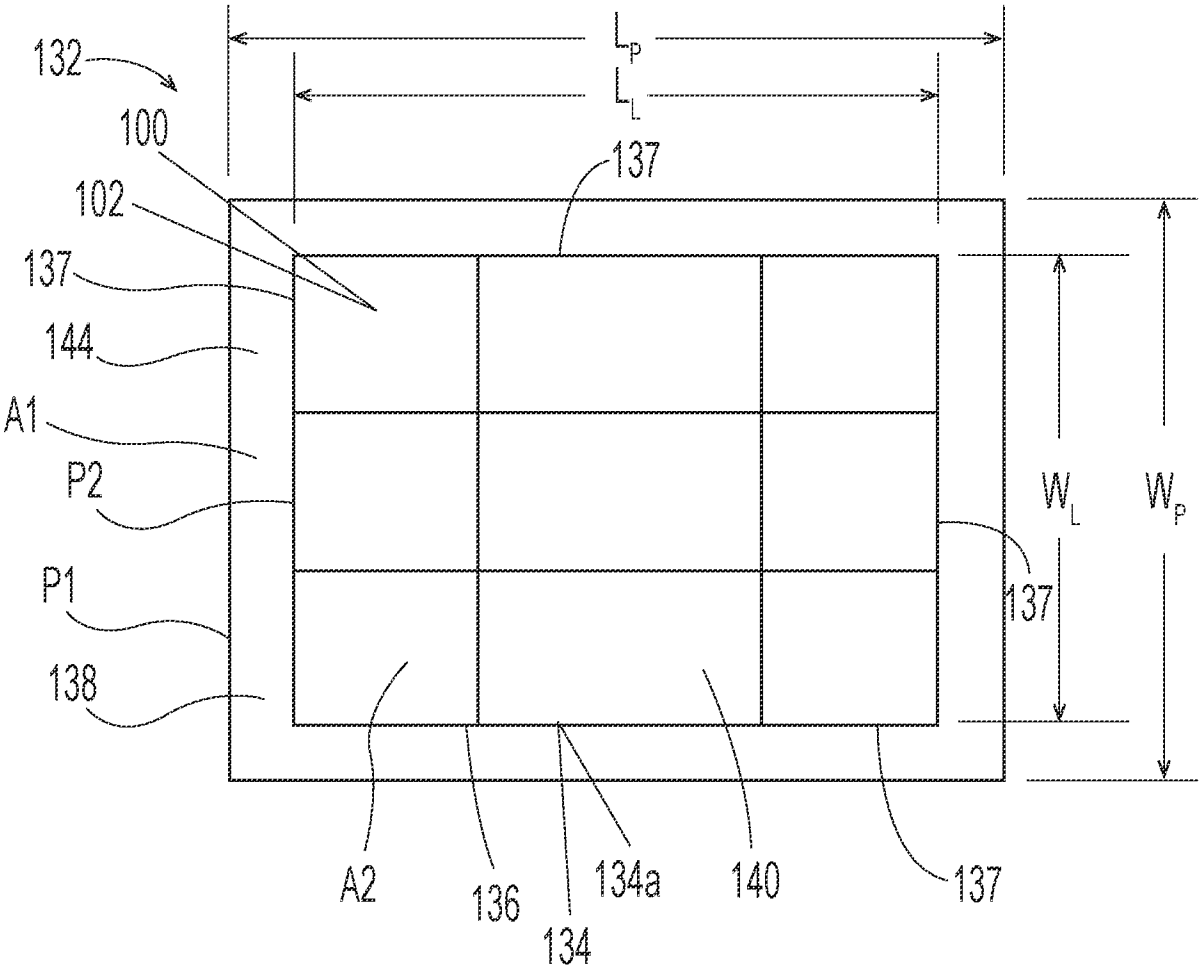
FIG. 5A is a sectional view of a bottom surface of the load and the pallet from FIG. 3A taken along the line 5A-5A.

While FIGS. 3A, 4, and 5A illustrate a symmetrical perimeter, FIGS. 3B, 3C, 3D, 5B, 5C, and 5D illustrate an asymmetrical perimeter, where portions of the load area A2 do not cover the full area of the pallet area A1, which can cause instability. Asymmetrical perimeters may be caused by a pallet that consists of rolled paper products having a large diameter, such as a pallet consisting only of toilet paper rolls having a roll diameter of 5.9 inches or greater (e.g., 6, 7, 8, 9, 10, 11, or 12 inches), or consisting only of paper towel rolls having roll diameters of 6.7 inches or greater (e.g., 7, 8, 9, 10, 11, 12, 13, 14, 15, or 16 inches). Asymmetrical perimeters may also be caused by a pallet that comprises two different roll diameters, or may be caused by a pallet that comprises three different roll diameters, or may be caused by a pallet that comprises four different roll diameters. Asymmetrical perimeters may also be caused by a pallet that comprises two different rolled paper products, such as a pallet that comprises toilet paper rolls and paper towel rolls on the same pallet.

Figure 5B:
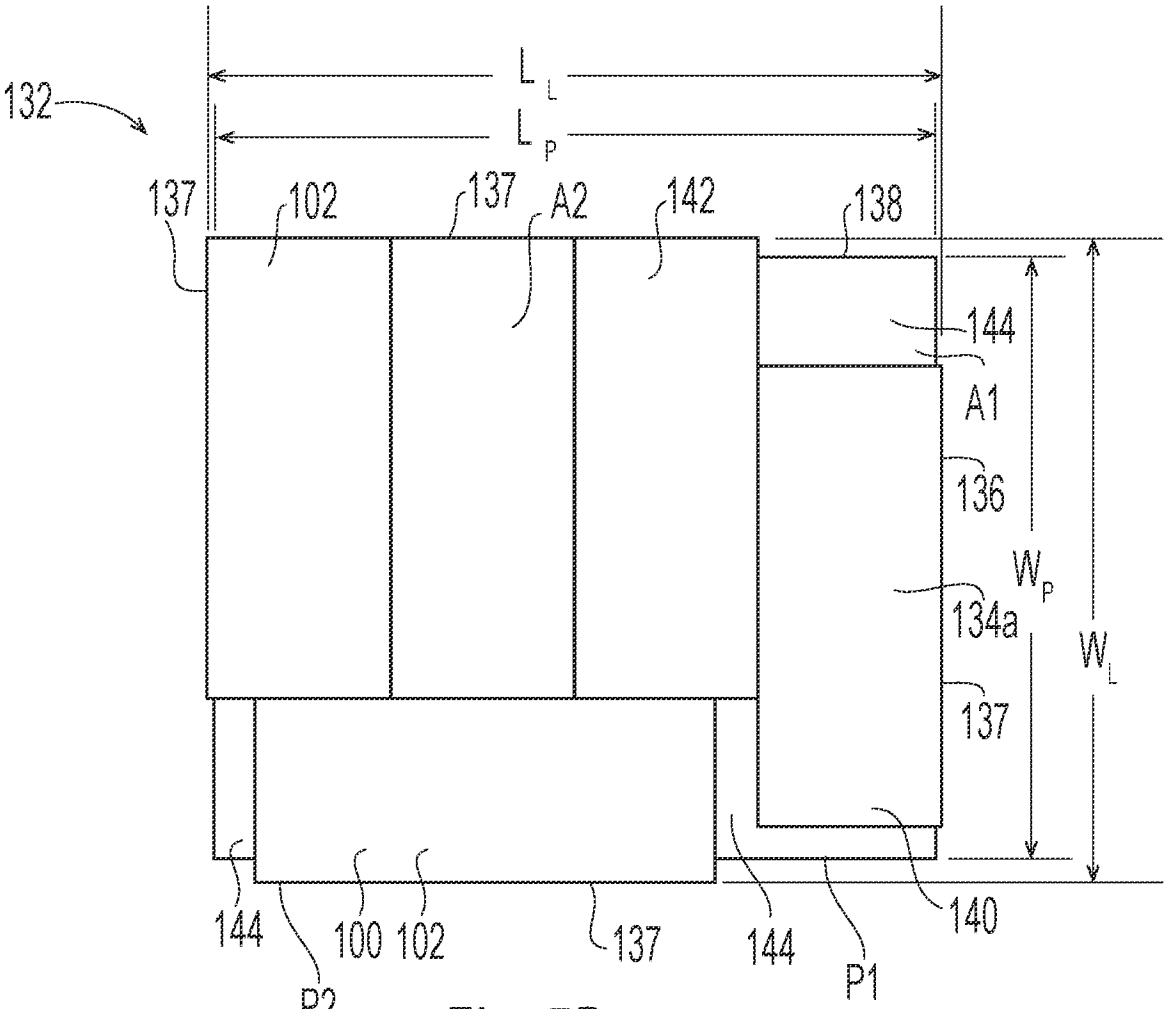
FIG. 5B is a sectional view of a bottom surface of the load and the pallet from FIG. 3B taken along the line 5B-5B.
Figure 5C:
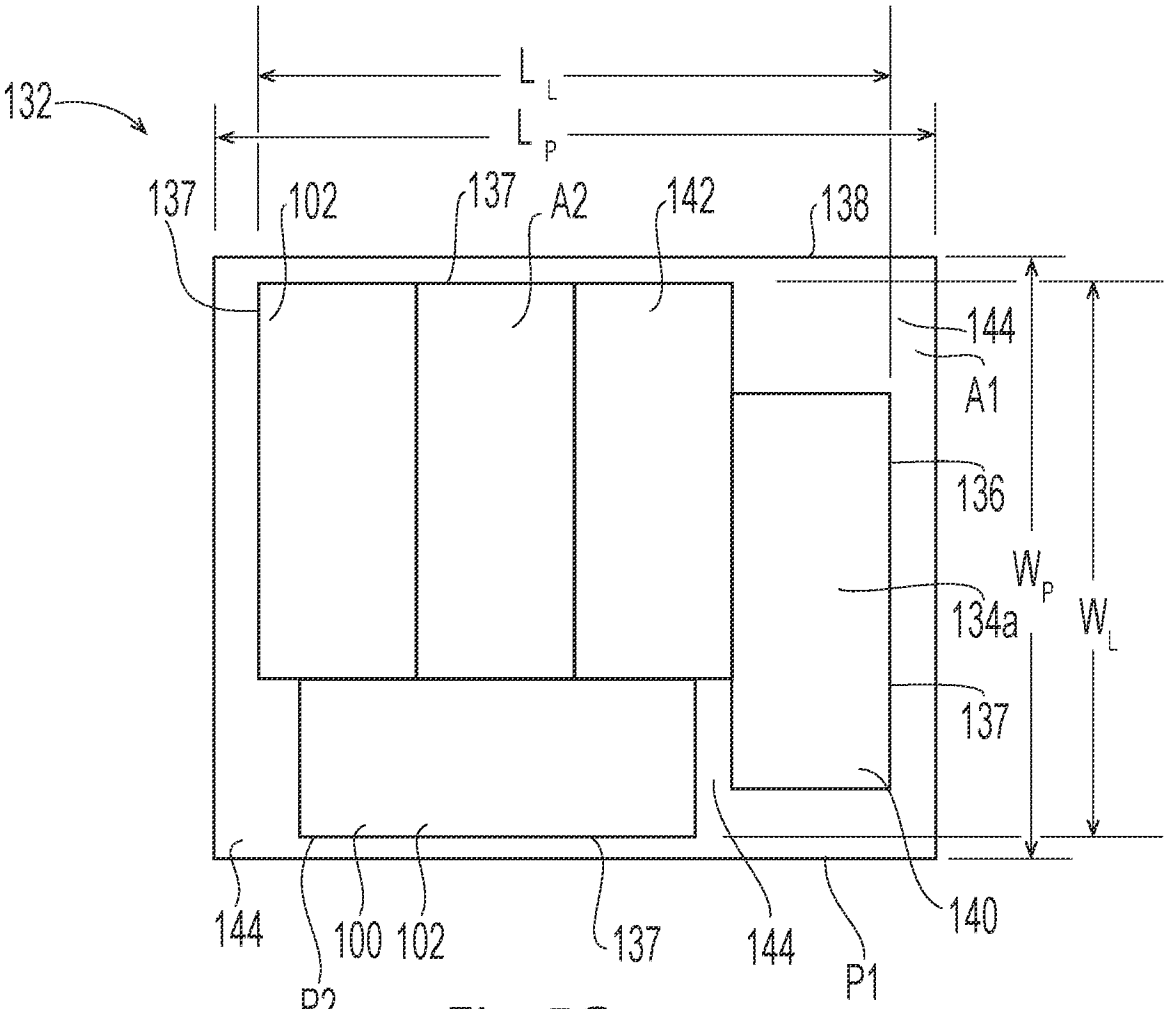
FIG. 5C is a sectional view of a bottom surface of the load and the pallet from FIG. 3C taken along the line 5C-5C.
Figure 5D:
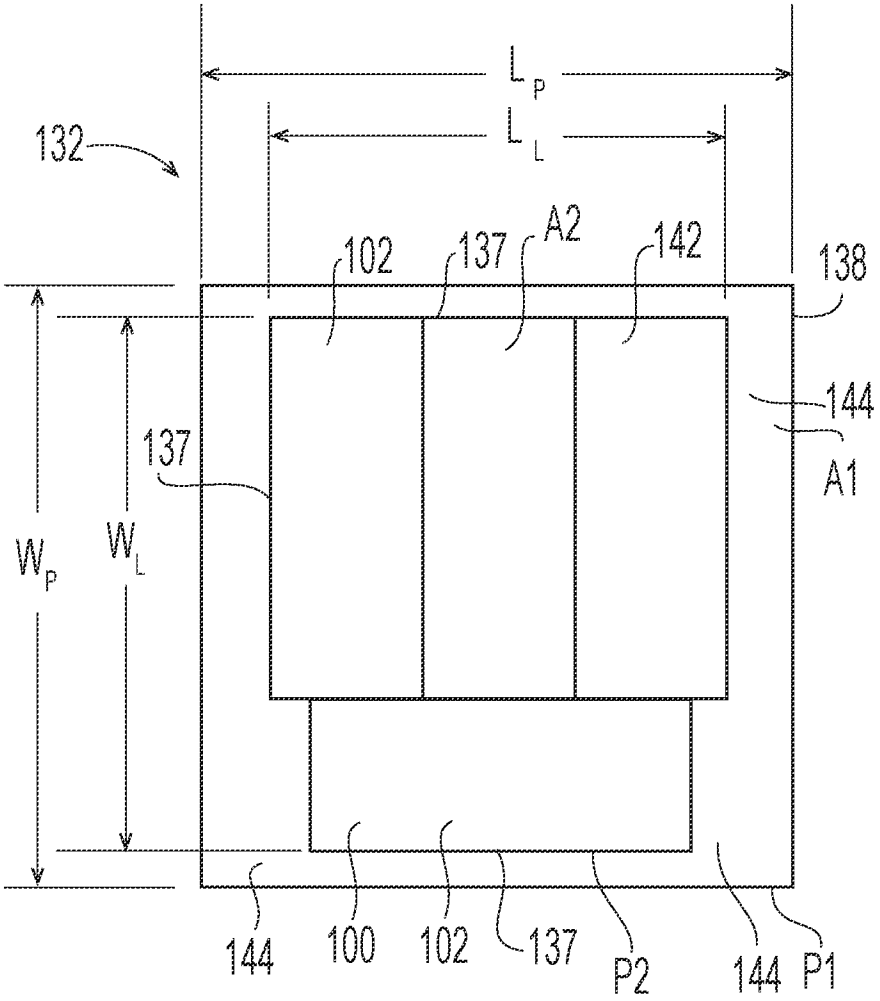
FIG. 5D is a sectional view of a bottom surface of the load and the pallet from FIG. 3D taken along the line 5D-5D.

In some cases, the load area A2 may only cover about 95%, about 90%, about 85%, about 80%, or about 75%, specifically reciting all 1% increments within the above-recited ranges and all ranges formed therein or thereby, of the pallet area A1, thus creating the potential for less stable cargo assemblages 132. FIGS. 3B and 5B also illustrate that the exposed pallet areas 144 may be at multiple locations of the pallet, creating zones of exposure that may lead to instability, even when the overall $W_L$ is larger than the $W_P$ and/or when the overall $L_L$ is larger than the $L_P$.

Figure 6A:
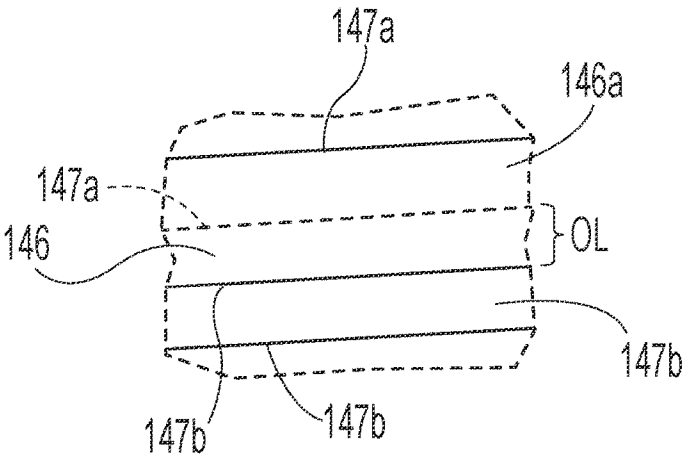
FIG. 6A is a detailed view of the film taken around the dashed shape 6A from FIG. 6.
Figure 6:
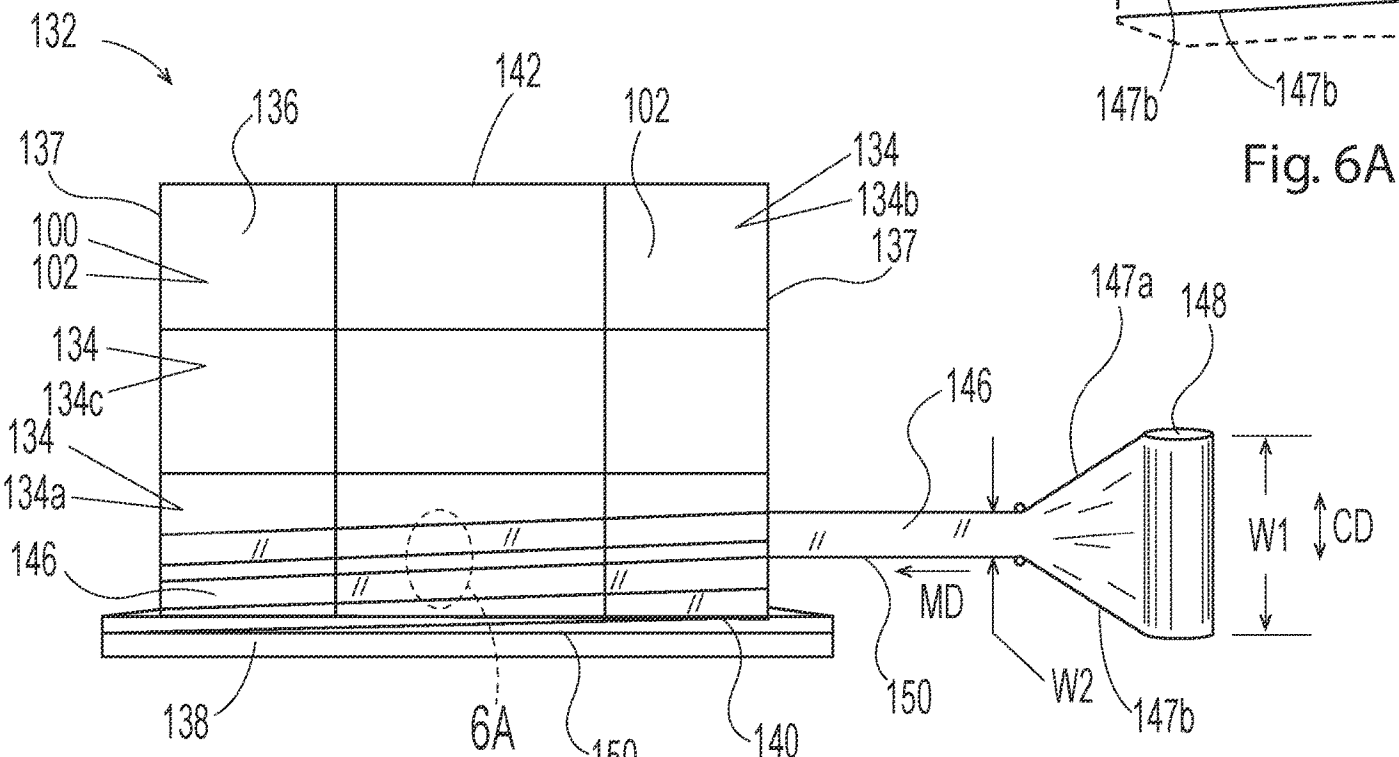
FIG. 6 is a schematic view of a film being wrapped around the load and the pallet.

As previously mentioned, the cargo assemblages 132 herein include film that is wrapped around the pallet 138 and layers 134 of containers 102 to secure the layers 134 of containers 102 in fixed positions with respect to each other and to the pallet 138. FIG. 6 shows a schematic representation of film 146 being dispensed from a roll 148 and being wrapped around the load 136 and pallet 138. It is to be appreciated that various apparatuses and/or methods may be used to wrap film 146 around the load 136 and the pallet 138 for transportation and/or storage, such as disclosed for example in U.S. Pat. Nos. 4,587,796; 5,155,970; 5,517,807; 6,195,961; 6,550,222; and 6,598,379, all of which are incorporated by reference herein. In some configurations, systems may use stretch wrapping machines to stretch, dispense, and wrap film material around the load 136 and pallet 138. In some configurations, stretch wrapping may be performed as an inline automated packaging technique that dispenses and wraps film 146 in a stretched condition around the load 136 on the pallet 138. Some pallet stretch wrapping methods and apparatuses may utilize a turntable, a rotating arm, or rotating ring to cover the sides 137 of the load 136 and pallet 138 with stretchable film 146. In such arrangements, relative rotation may be provided between the load 136 and a packaging material dispenser to wrap film 146 about the sides 137 of the load 136 and pallet 138. It is also to be appreciated that various types of film 146 may be wrapped around the load 136 and pallet 138. For example, film 146 may be made from nylon, polypropylene, PVC, and polyethylene, such as disclosed for example, in U.S. Pat. No. 5,031,771, which is incorporated by reference herein.

It is to be appreciated that 146 film having various thicknesses may be used. For example, in some configurations, the film 146 may comprise an unstretched thickness gauge of about $45\times10^{-5}$ inches to about $90\times10^{-5}$ inches, specifically reciting all $1\times10^{-5}$ inch increments within the above-recited ranges and all ranges formed therein or thereby. As shown in FIG. 6, the film 146 may define a width in a cross direction CD extending between a first edge 147*a* and a second edge 147*b*. The film 146 may be pre-stretched in various amounts in a machine direction MD before being wrapped onto the load 136 and/or pallet 138. In some configurations, the film 146 may be pre-stretched from about 100% to about 250%, specifically reciting all 1% increments within the above-recited ranges and all ranges formed therein or thereby. Thus, the film 146 may define an unstretched width W1 in the cross direction CD and may define a stretched width W2 that is less than the unstretched width W1. In some configurations, the film 146 may comprise an unstretched width W1 of about 20 inches to about 30 inches, specifically reciting all 0.5 inch increments within the above-recited ranges and all ranges formed therein or thereby. In some configurations, the film 146 may comprise a stretched width W2 of about 16 inches to about 30 inches, specifically reciting all 0.5 inch increments within the above-recited ranges and all ranges formed therein or thereby. It is also to be appreciated that the film may also include a roped portion 150. As discussed herein, "roping" film or a "roped" portion 150 of film 146 means rolling or twisting or collapsing an edge portion of the film 146 to shape it into a rope-like form, such as disclosed for example in U.S. Pat. No. 5,031,771 and U.S. Patent Publication No. 2001/0015050 A1, which are incorporated by reference herein. As shown in FIG. 6A, one layer of film 146*a* may be applied so as to overlap with a previously applied layer of film 146*b* define various levels of overlap distances OL. In some configurations, the film 146 may be applied to define an overlap distance OL of about 3 inches to about 20 inches, specifically reciting all 0.5 inch increments within the above-recited ranges and all ranges formed therein or thereby.

With regard to the cargo assemblages herein 132, the film 146 may be wrapped around the load 136 and/or pallet 138 with wrap profiles that help reduce the relative quantities of film needed to secure the load 136 on the pallet 138 while at the same time helping to increase load stability during shipping. As discussed in more detail below, the wrap profiles herein may include two more layers of film 146 that may be applied to have different containment forces; different tensions; and/or different locations with respect to the load 136, the pallet 138, and/or each other. As used herein, the number of layers corresponds with the number of times the film is wrapped around a layer of containers, a load, and/or a pallet. For example, one layer of film is defined by continuous length of film that is wrapped once around the perimeter of a layer of containers, a load, and/or a pallet. In another example, two layers of film is defined by continuous length of film that is wrapped twice around the perimeter of a layer of containers, a load, and/or a pallet. The various levels of containment forces discussed herein may be measured according to the Containment Force Test Method described herein.

Figure 7A:
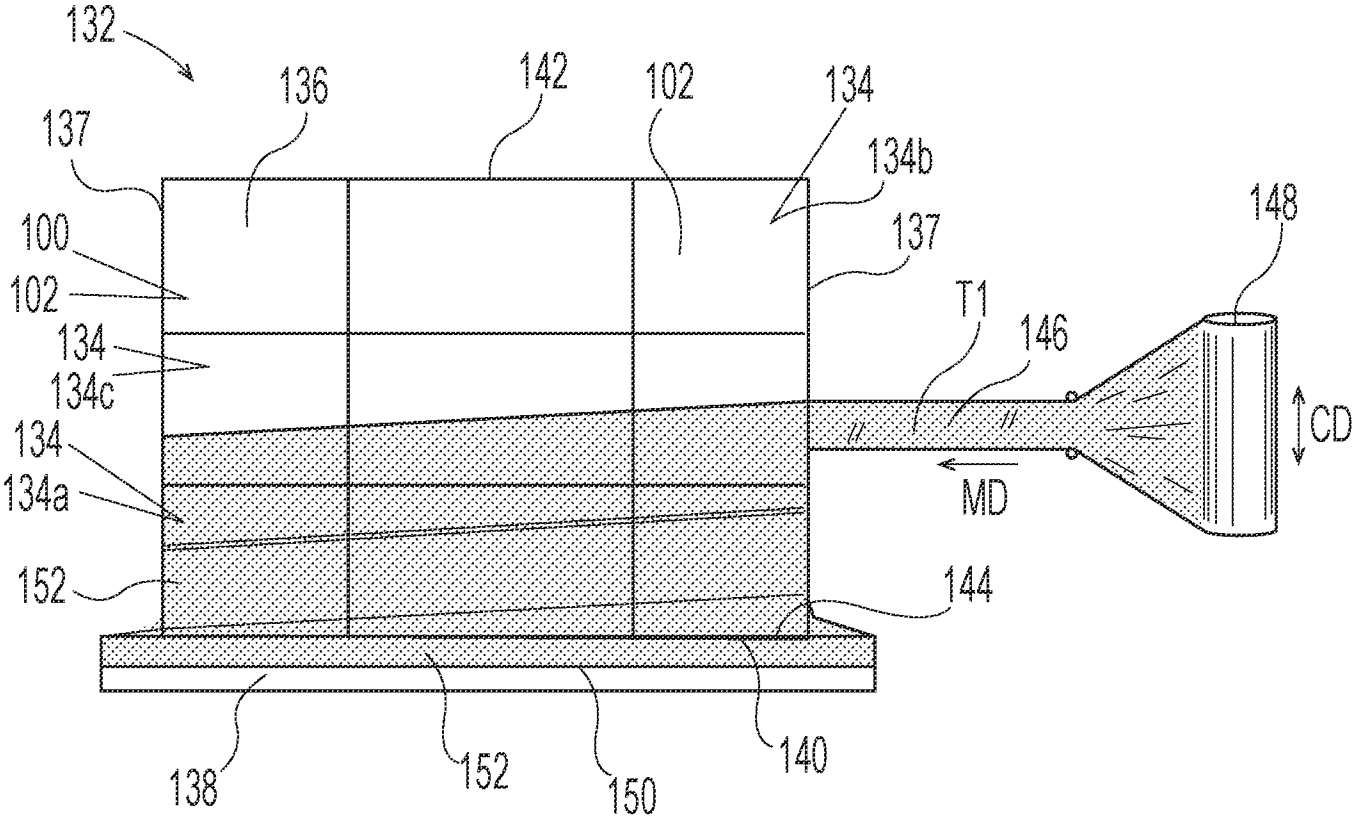
FIG. 7A is a schematic view of the cargo assemblage of FIG. 4 with film being applied in a first wrap profile including first layers of film wrapped around the load and pallet.
Figure 7B:
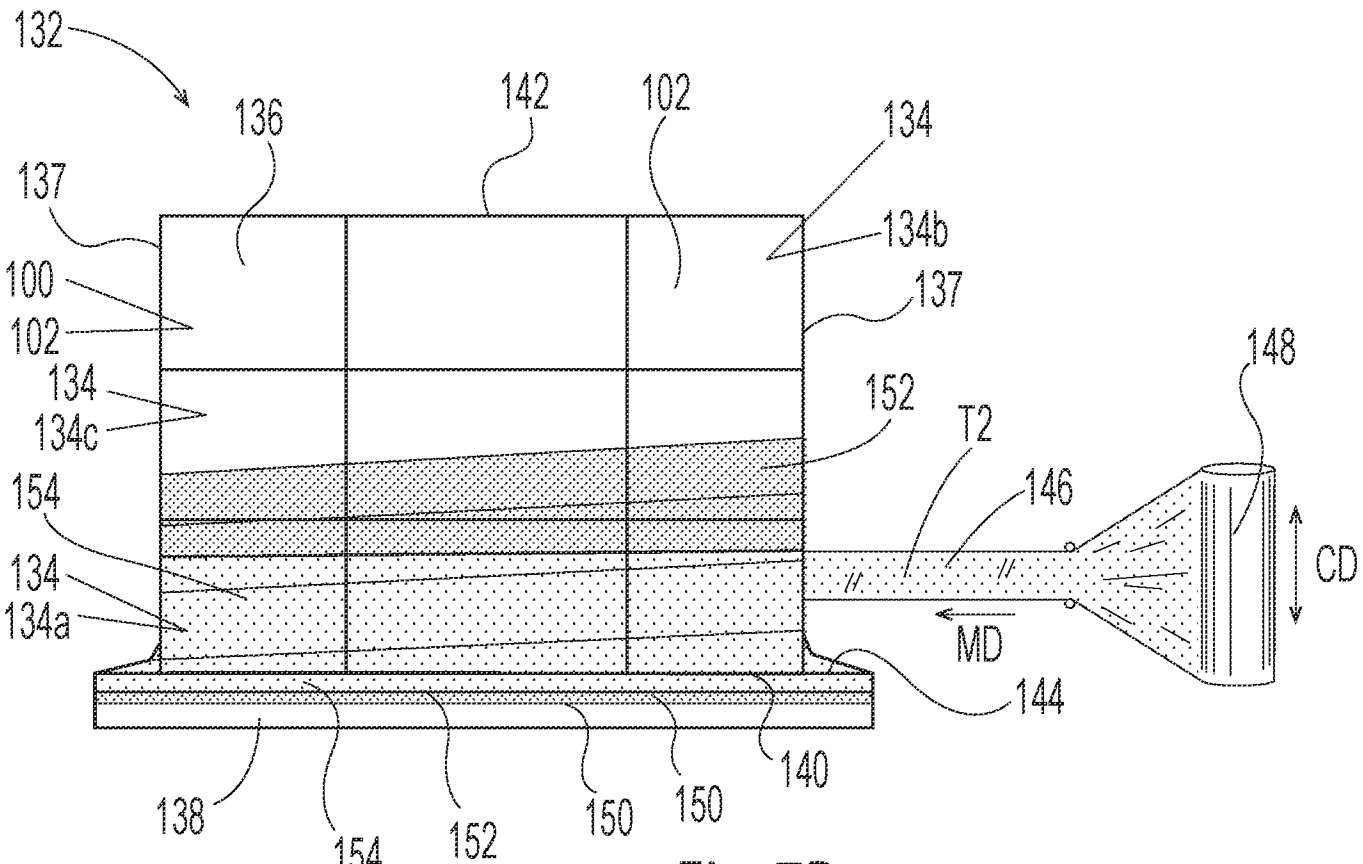
FIG. 7B is a schematic view of the cargo assemblage of FIG. 7A with film being applied in the first wrap profile including second layers of film wrapped around the first layers of film.
Figure 7C:
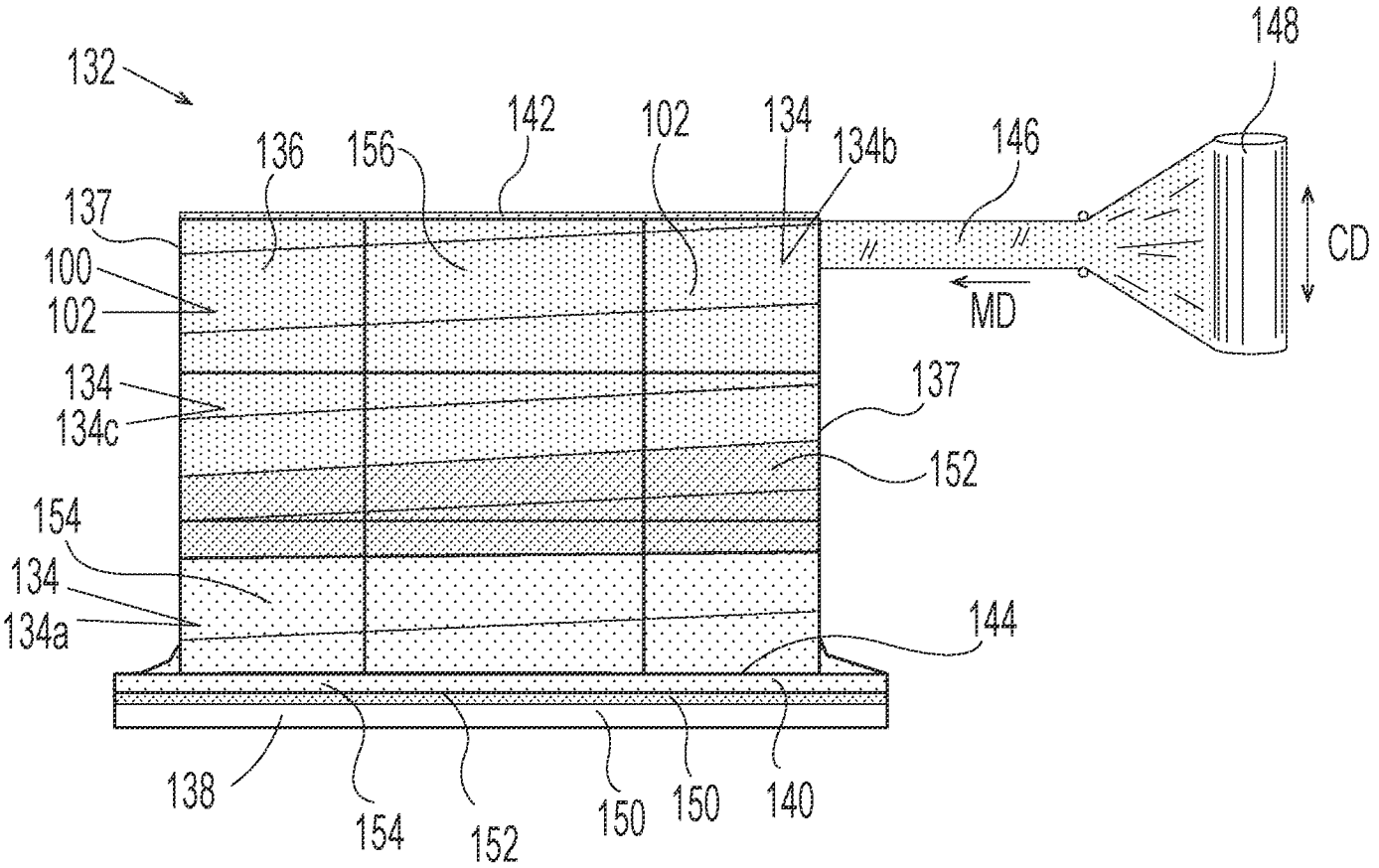
FIG. 7C is a schematic view of the cargo assemblage of FIG. 7B with film being applied in the first wrap profile including third layers of film wrapped around load.

FIGS. 7A-7C provide illustrations of an example of a first wrap profile showing the cargo assemblage 132 of FIG. 4 with film 146 wrapped around the load 136 and pallet 138. With reference to FIGS. 4 and 7A, first layers 152 of film 146 are wrapped with a first tension T1 around the pallet 138 and the bottom layer 134*a* of containers 102 to connect the load 136 with the pallet 138. The first layers 152 of film 146 may comprise roped portions 150 that are wrapped around the perimeter of the pallet 138 below the bottom surface 140 of the of load 136 and/or the support deck 144. As shown in FIG. 7A, the first layers 152 of film 146 may also be wrapped with the first tension T1 around the bottom layer 134*a* of containers 102 and the layer 134 of containers 102 stacked on the bottom layer 134*a* of containers 102. As such, the first layers 152 of film 146 may also connect the bottom layer 134*a* of containers 102 with the layer 134 of containers 102 stacked on the bottom layer 134*a* of containers 102.

Referring now to FIGS. 7A and 7B, second layers 154 of film 146 with a second tension T2 may be wrapped around the first layers 152 of film 146 wherein, the first tension T1 may be less than the second tension T2. The second layers 154 of film 146 may comprise roped portions 150 that are wrapped around the perimeter of the pallet 138 below the bottom surface 140 of the of load 136 and/or the support deck 144. It is to be appreciated that the roped portions 150 of the first layers 152 and the second layers 154 of film 146 may be positioned at various distances below the bottom surface 140 of the load 136 and/or the support deck 144. For example, in some configurations, the roped portions 150 of the first layers 152 of film 146 and/or the second layers 154 of film 146 may be positioned from about 1.5 inches to about 2.5 inches below the bottom surface 140 of the load 136 and/or the support deck 144, specifically reciting all 0.05 inch increments within the above-recited ranges and all ranges formed therein or thereby. Referring now to FIGS. 7B and 7C, third layers 156 of film 146 may be wrapped around the top layer 134*b* of containers 102. The third layers 156 of film may also be wrapped around the load 136 to connect neighboring layers 134 of containers 102 together. For example, the third layers 156 of film may be wrapped around top layer 134*b* of containers 102 and one or more intermediate layers 134*c* of containers 102.

With reference to the first wrap profile of illustrated in FIGS. 7A-7C, the film 146 may be wrapped around the bottom layer 134*a* of containers 102 with a bottom containment force from about 5 pounds to about 9 pounds, or from about 6 pounds to about 8 pounds, specifically reciting all 0.1 pound increments within the above-recited ranges and all ranges formed therein or thereby; these force ranges may be desirable when used with a symmetrical perimeter. When wrapping the film 146 around the bottom layer 134*a* of an asymmetrical perimeter, it may be desirable to use a bottom containment force from about 5 pounds to about 12 pounds, or from about 6 pounds to about 12 pounds, or from about 7 pounds to about 11 pounds, specifically reciting all 0.1 pound increments within the above-recited ranges and all ranges formed therein or thereby. The film 146 may also be wrapped around the top layer 134*b* of containers 102 with a top containment force that may be less than the bottom containment force. The top containment force may be from about 3 pounds to about 7 pounds, or from about 4 pounds to about 6 pounds, specifically reciting all 0.1 pound increments within the above-recited ranges and all ranges formed therein or thereby; these force ranges may be desirable when used with a symmetrical perimeter. When wrapping the film 146 around the top layer 134*b* of an asymmetrical perimeter, it may be desirable to use a top containment force from about 3 pounds to about 9 pounds, or from about 4 pounds to about 9 pounds, or from about 5 pounds to about 8 pounds, specifically reciting all 0.1 pound increments within the above-recited ranges and all ranges formed therein or thereby. In some configurations, the film 146 may be wrapped around the one or more intermediate layers 134*c* of containers 102 with a middle containment force from about 4 pounds to about 6 pounds, specifically reciting all 0.1 pound increments within the above-recited ranges and all ranges formed therein or thereby. In some configurations, the film 146 may be wrapped around neighboring layers 134 of containers 102 with a middle containment force from about 4 pounds to about 6 pounds, specifically reciting all 0.1 pound increments within the above-recited ranges and all ranges formed therein or thereby.

With further regard to the first wrap profile illustrated in FIGS. 7A-7C, it is also to be appreciated the first layers 152 of film 146, the second layers 154 of film 146, and the third layers 156 of film 146 may include various: numbers of layers; overlap distances; levels of pre-stretching; and/or levels of containment forces. For example, in some configurations, the first layers 152 of film 146 may comprise 3 or more layers; the second layers 154 of film 146 may comprise 6 or more layers; and/or the third layers 156 of film 146 may comprise 2 or more layers. In some configurations, the third layers 156 of film 146 may comprise 3 layers. In some configurations, the first layers 152 of film 146 and/or the second layers 154 of film 146 may comprise an overlap distance OL of about 17 inches. In some configurations, the first layers 152 of film 146 and/or the second layers 154 of film 146 may be pre-stretched by about 208%. In some configurations, the first layers 152 of film and/or the second layers 154 of film 146 may be wrapped with a containment force from about 6 pounds to about 8 pounds, specifically reciting all 0.1 pound increments within the above-recited ranges and all ranges formed therein or thereby. And the third layers 156 of film 146 may be wrapped with a containment forces from about 4 pounds to about 6 pounds, specifically reciting all 0.1 pound increments within the above-recited ranges and all ranges formed therein or thereby.

Figure 8A:
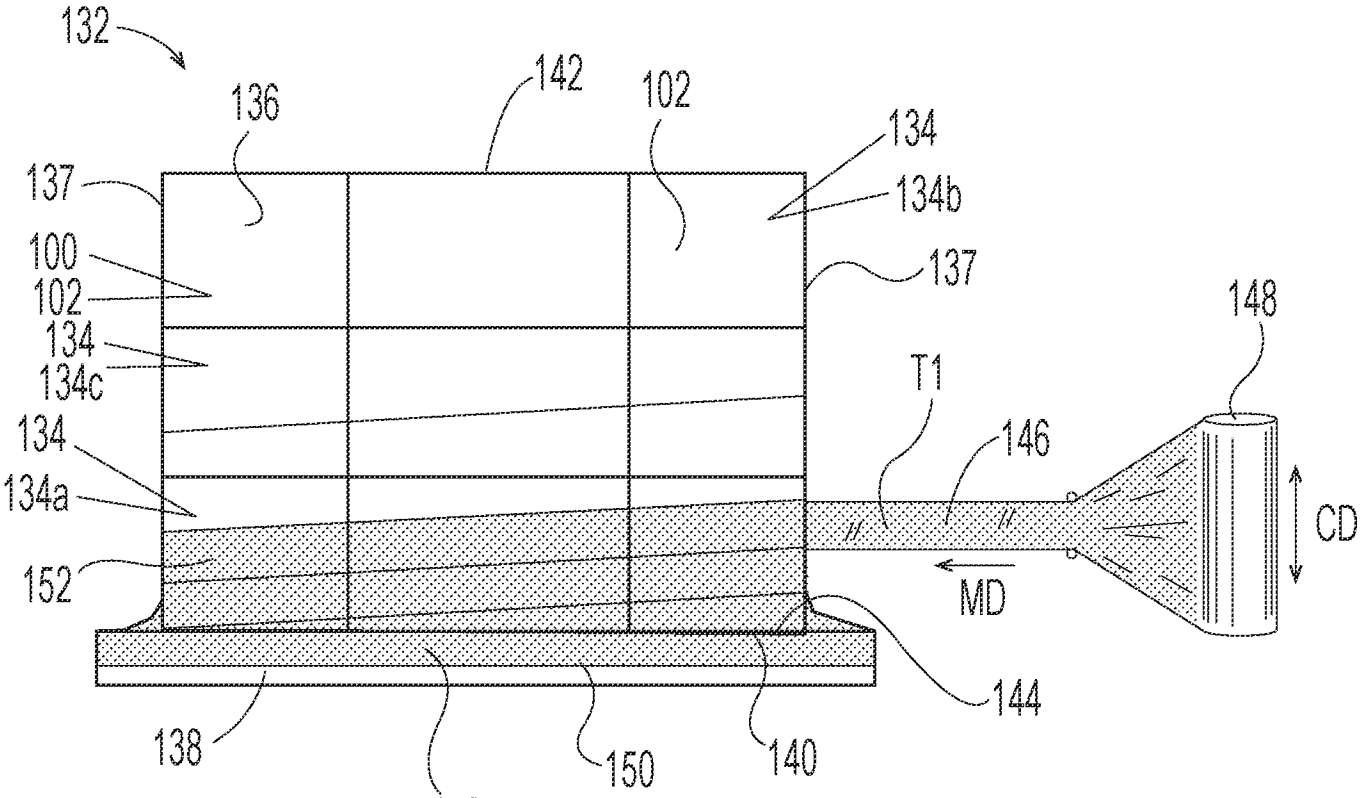
FIG. 8A is a schematic view of the cargo assemblage of FIG. 4 with film being applied in a second wrap profile including first layers of film wrapped around the load and pallet.
Figure 8B:
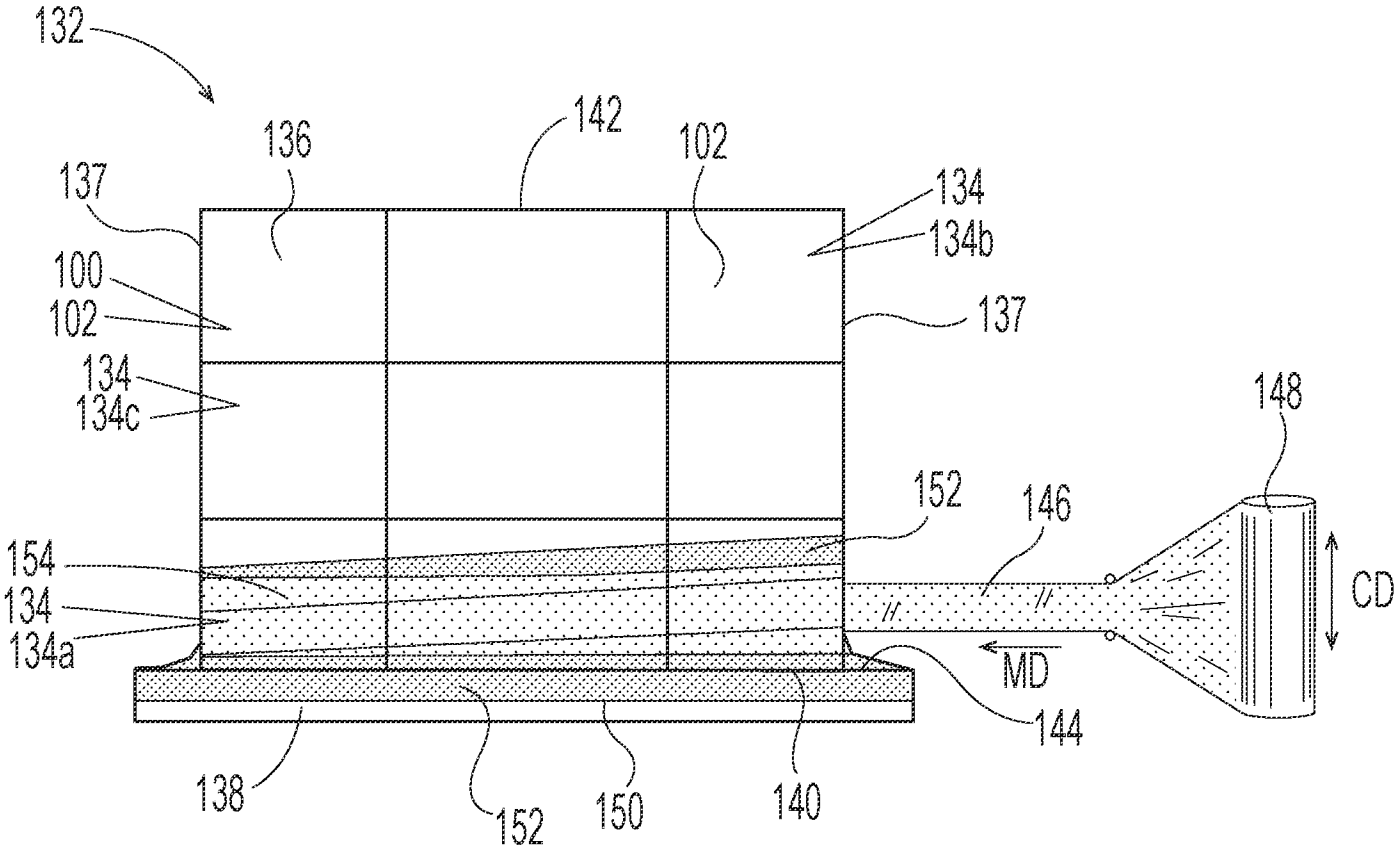
FIG. 8B is a schematic view of the cargo assemblage of FIG. 8A with film being applied in the second wrap profile including second layers of film wrapped around the first layers of film.
Figure 8C:
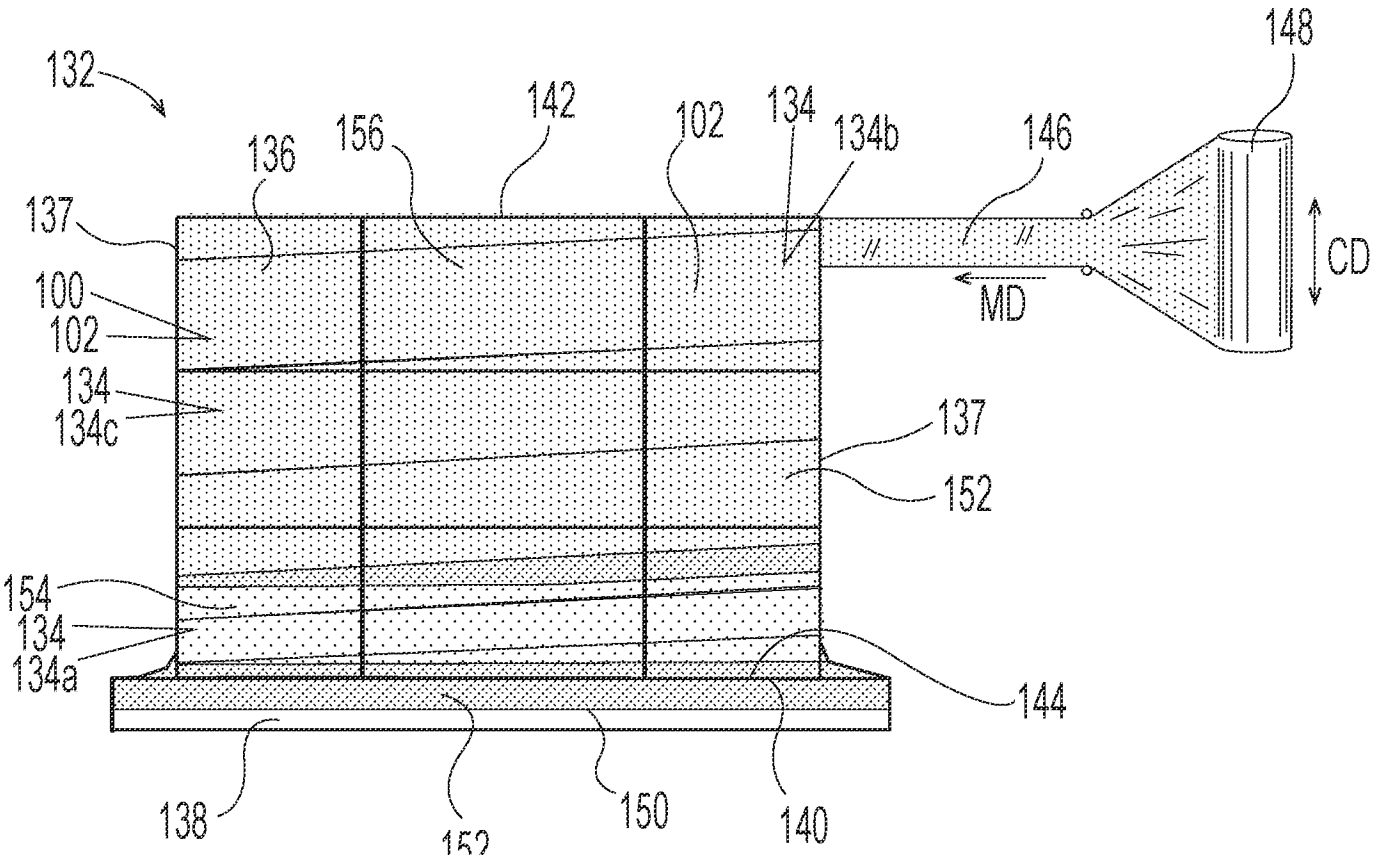
FIG. 8C is a schematic view of the cargo assemblage of FIG. 8B with film being applied in the second wrap profile including third layers of film wrapped around load.

FIGS. 8A-8C provide illustrations of an example of a second wrap profile showing the cargo assemblage 132 of FIG. 4 with film 146 wrapped around the load 136 and pallet 138. With reference to FIGS. 4 and 8A, first layers 152 of film 146 are wrapped around the pallet 138 and the bottom layer 134*a* of containers 102 to connect the load 136 with the pallet 138. The first layers 152 of film 146 may comprise roped portions 150 that are wrapped around the perimeter of the pallet 138 below the bottom surface 140 of the of load 136 and/or the support deck 144. It is to be appreciated that the roped portions 150 of the first layers 152 of film 146 may be positioned at various distances below the bottom surface 140 of the load 136 and/or the support deck 144. For example, in some configurations, the roped portions 150 of the first layers 152 of film 146 may be positioned from about 1.5 inches to about 2.5 inches below the bottom surface 140 of the load 136 and/or the support deck 144, specifically reciting all 0.05 inch increments within the above-recited ranges and all ranges formed therein or thereby.

Referring now to FIGS. 8A and 8B, second layers 154 of film 146 may be wrapped around the first layers 152 of film 146 around the bottom layer 134*a* of containers 102 such that all the second layers 154 of film 146 are positioned above the pallet 138. It is to be appreciated that the second layers 154 of film 146 may be positioned at various distances above the support deck 144 and/or bottom surface 140 of the load 136. For example, in some configurations, the second layers 154 of film 146 may be positioned at distances greater than zero to about 1 inch above the bottom surface 140 of the load 136 and/or the support deck 144, specifically reciting all 0.05 inch increments within the above-recited ranges and all ranges formed therein or thereby.

Referring now to FIGS. 8B and 8C, third layers 156 of film 146 may be wrapped around the top layer 134*b* of containers 102. The third layers 156 of film may also be wrapped around the load 136 to connect neighboring layers 134 of containers 102 together. For example, the third layers 156 of film may be wrapped around the top layer 134*b* of containers 102 and one or more intermediate layers 134*c* of containers 102.

With reference to the second wrap profile of illustrated in FIGS. 8A-8C, the film 146 may be wrapped around the bottom layer 134*a* of containers 102 with a bottom containment force from about 6 pounds to about 8 pounds, specifically reciting all 0.1 pound increments within the above-recited ranges and all ranges formed therein or thereby. The film 146 may also be wrapped around the top layer 134*b* of containers 102 with a top containment force from about 4 pounds to about 6 pounds, specifically reciting all 0.1 pound increments within the above-recited ranges and all ranges formed therein or thereby. In some configurations, the film 146 may be wrapped around the one or more intermediate layers 134*c* of containers 102 with a middle containment force from about 4 pounds to about 6 pounds, specifically reciting all 0.1 pound increments within the above-recited ranges and all ranges formed therein or thereby. In some configurations, the film 146 may be wrapped around neighboring layers 134 of containers 102 with a middle containment force from about 4 pounds to about 6 pounds, specifically reciting all 0.1 pound increments within the above-recited ranges and all ranges formed therein or thereby.

With regard to the second wrap profile illustrated in FIGS. 8A-8C, it is also to be appreciated the first layers 152 of film 146, the second layers 154 of film 146, and the third layers 156 of film 146 may include various: numbers of layers; overlap distances; levels of pre-stretching; and/or levels of containment forces. For example, in some configurations, the first layers 152 of film 146 may comprise 7 or more layers; the second layers 154 of film 146 may comprise 3 or more layers; and/or the third layers 156 of film 146 may comprise 2 or more layers. In some configurations, the third layers 156 of film 146 may comprise 3 layers. In some configurations, the first layers 152 of film 146 and/or the second layers 154 of film 146 may comprise an overlap distance OL of about 12 inches. In some configurations, the first layers 152 of film 146 and/or the second layers 154 of film 146 may be pre-stretched by about 146%. In some configurations, the first layers 152 of film may be wrapped with a containment force from about 6 pounds to about 8 pounds, specifically reciting all 0.1 pound increments within the above-recited ranges and all ranges formed therein or thereby. And the second layers 154 of film 146 and/or the third layers 156 of film 146 may be wrapped with a containment forces from about 4 pounds to about 6 pounds, specifically reciting all 0.1 pound increments within the above-recited ranges and all ranges formed therein or thereby.

It is to be appreciated that various additional wrap profiles may be used with the cargo assemblages herein. For example, the film 146 may comprise a wrap profile defined by first layers 152 of film 146 that connect the bottom layer 134*a* of containers 102 with the pallet 138 and second layers 154 of film 146 that connect neighboring stacked layers 134 together, wherein the first layers 152 of film are wrapped around the pallet 138 and the bottom layer 134*a* of containers 102 with a first containment force from about 6 pounds to about 8 pounds, and wherein the second layers 154 of film 146 are wrapped around neighboring layers 134 of containers 102 with a second containment force that is greater than about 4 pounds, wherein the second containment force may be less than the first containment force. In some configurations, the film 146 may be wrapped around the bottom layer 134*a* of containers 102 with a bottom containment force from about 6 pounds to about 8 pounds, specifically reciting all 0.1 pound increments within the above-recited ranges and all ranges formed therein or thereby. In some configurations, the film 146 may be wrapped around the top layer 134*b* of containers 102 with a top containment force from about 4 pounds to about 6 pounds, specifically reciting all 0.1 pound increments within the above-recited ranges and all ranges formed therein or thereby. In some configurations, the film 146 may be wrapped around the one or more intermediate layers 134*c* of containers 102 with a middle containment force from about 4 pounds to about 6 pounds, specifically reciting all 0.1 pound increments within the above-recited ranges and all ranges formed therein or thereby. In some configurations, the film 146 may be wrapped around neighboring layers 134 of containers 102 with a middle containment force from about 4 pounds to about 6 pounds, specifically reciting all 0.1 pound increments within the above-recited ranges and all ranges formed therein or thereby.

Roll Density Test Method

For this test, the rolled paper product roll is the test sample. Remove all of the test rolled paper product rolls from any packaging and allow them to condition at about 23° C.±2° C.° and about 50%±2% relative humidity for 24 hours prior to testing. Rolls with cores that are crushed, bent or damaged should not be tested.

The Roll Density is calculated by dividing the mass of the roll by its volume using the following equation:

$$\text{Roll Density}\left(\frac{\text{g}}{\text{cm}^3}\right) = \frac{\text{Mass (g)}}{\text{Roll Width (cm)}\cdot\pi\left[\text{Outer Radius (cm)}^2 - \text{Inner Radius (cm)}^2\right]}$$

Figure 9:
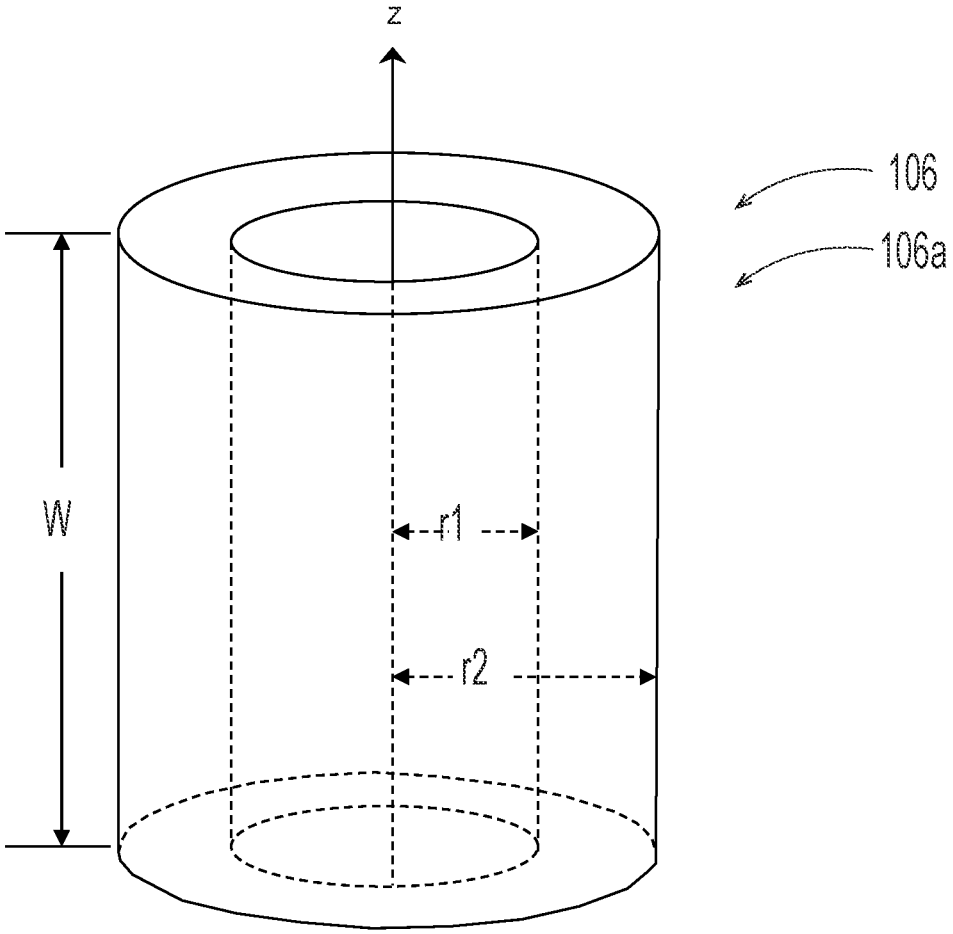
FIG. 9 is a schematic representation of a rolled paper product roll for use in measuring a rolled paper product roll's Roll Density as measured according to the Roll Density Test Method described herein.

FIG. 9 visually describes the measurement of a rolled paper product roll 10 where Z is the center axis of the roll, where the outer radius $r_2$ in units of cm is measured using the Roll Diameter Test Method described herein, the inner radius $r_1$ in units of cm is measured using a caliper tool inside the core, the roll width W is measured using a ruler or tape measure in units of cm and the mass in units of g is the weight of the entire roll including core.

In like fashion analyze a total of ten (10) replicate sample rolls. Calculate the arithmetic mean of the 10 values and report the Roll Density to the nearest 0.001 g/cm$^3$.

Roll Diameter Test Method

For this test, the actual rolled paper product roll is the test sample. Remove all of the test rolled paper product rolls from any packaging and allow them to condition at about 23° C.±2° C.° and about 50%±2% relative humidity for 24 hours prior to testing. Rolls with cores that are crushed, bent or damaged should not be tested.

The diameter of the test rolled paper product roll is measured directly using a Pi® tape of appropriate length or equivalent precision diameter tape (e.g. an Executive Diameter tape available from Apex Tool Group, LLC, Apex, NC, Model No. W606PD) which converts the circumferential distance into a diameter measurement, so the roll diameter is directly read from the scale. The diameter tape is graduated to 0.01 inch increments. The tape is 0.25 inches wide and is made of flexible metal that conforms to the curvature of the test sanitary tissue product roll but is not elongated under the loading used for this test.

Loosely loop the diameter tape around the circumference of the test rolled paper product roll, placing the tape edges directly adjacent to each other with the surface of the tape lying flat against the test rolled paper product roll. Pull the tape snug against the circumference of the test rolled paper product roll, applying approximately 100 g of force. Wait 3 seconds. At the intersection of the diameter tape, read the diameter aligned with the zero mark of the diameter tape and record as the Roll Diameter to the nearest 0.01 inches. The outer radius of the rolled paper product roll is also calculated from this test method.

In like fashion analyze a total of ten (10) replicate sample rolled paper product rolls. Calculate the arithmetic mean of the 10 values and report the Roll Diameter to the nearest 0.01 inches.

Containment Force Test Method

The Containment Force is a measurement of the cumulative force from the layers of film wrapped around a load of containers on a pallet. The Containment Force is measured using the CFT-6 tool, available from Lantech, Jeffersontown, KY, or an equivalent. The CFT-6 tool is to be calibrated and operated according to the manufacturer's instructions, with the exception of any deviations described below.

The CFT-6 tool's positioning cable is used to identify the horizontal position, approximately 559 mm (22") from the corner of the load, at which the measurement is to be made. Measurements are to be made on the short side of the load at three different vertical locations; 64 mm (2.5") from the top of the load, middle of the load height, and bottom, such that the end of the piercing finger is positioned just above the top surface of the pallet.

Once the horizontal and vertical position of the measurement is identified the piercing finger rod is pushed through all layers of film at that location, and the entire piercing finger is fully inserted vertically between the layers of film and the underlying containers. Such that the film covers all but approximately 6 mm (0.25") of the top of the piercing finger, and the film layers are now located between the piercing finger and a parallel fulcrum finger rod. Care should be taken to avoid piercing the underlying containers, and slight deviations in the horizontal positioning are allowed to identify the optimal location (e.g., the gap created where two rolled products meet).

A force gauge scale is attached by a scale lever to the finger rods. The scale is slowly pulled to the left in the horizontal direction applying tension to the film between the piercing finger and the fulcrum finger until the green stripe on the position indicator shows in the slot, and then the tension is released on the scale. The scale is programmed to display the peak force value in pounds, and is recorded as the Containment Force to the nearest 0.1 pounds of force. Containment Force values are reported individually for the top, middle, and bottom locations on the load.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cargo assemblage comprising:

a pallet comprising a first perimeter;

a load comprising a bottom surface and a top surface, the bottom surface comprising a second perimeter, the load comprising containers of absorbent paper product, the containers arranged in stacked layers from a bottom layer of containers to a top layer of containers;

a film connecting the load with the pallet and connecting neighboring stacked layers together, the film comprising a wrap profile, the wrap profile comprising first layers of film that connect the bottom layer of containers with the pallet and second layers of film that connect neighboring stacked layers together, wherein the film is wrapped around the bottom layer of containers with a bottom containment force, and wherein the film is wrapped around the top layer of containers with a top containment force; and wherein the bottom containment force is greater than the top containment force.

2. The cargo assemblage of claim 1, wherein the bottom containment force is from about 5 pounds to about 9 pounds.

3. The cargo assemblage of claim 2, wherein the film is wrapped around neighboring layers of containers with a middle containment force that is less than the bottom containment force.

4. The cargo assemblage of claim 1, further comprising at least one (Original) intermediate layer of containers positioned between the top layer of containers and the bottom layer of containers.

5. The cargo assemblage of claim 4, wherein the film is wrapped around the at least one intermediate layer of containers with a middle containment force that is less than the bottom containment force.

6. The cargo assemblage of claim 1, wherein the bottom layer of containers defines the bottom surface of the load and the top layer of containers defines the top surface of the load.

7. The cargo assemblage of claim 1, wherein the first layers of film comprise a roped portion.

8. The cargo assemblage of claim 1, wherein the film comprises an unstretched thickness gauge of about $45\times10^{-5}$ inches to about $90\times10^{-5}$ inches.

9. The cargo assemblage of claim 1, wherein the film comprises an unstretched width of about 20 inches to about 30 inches.

10. The cargo assemblage of claim 1, wherein the film comprises a stretched width of about 16 inches to about 30 inches.

11. The cargo assemblage of claim 1, wherein the film is pre-stretched from about 100% to about 250%.

12. The cargo assemblage of claim 1, wherein the film comprises an overlap of about 3 inches to about 20 inches.

13. The cargo assemblage of claim 1, wherein the first layers of film comprise from about 4 layers to about 7 layers of film.

14. The cargo assemblage of claim 1, wherein the pallet comprises a CHEP pallet.

15. The cargo assemblage of claim 1, wherein the pallet comprises a GMA pallet.

16. The cargo assemblage of claim 1, wherein second perimeter of the bottom surface is completely surrounded by the first perimeter of the pallet.

17. The cargo assemblage of claim 1, wherein the absorbent paper product comprises rolled paper product.

18. The cargo assemblage of claim 17, wherein the rolled paper product comprises an absorbent towel substrate, a sanitary tissue substrate, or a cellulosic fiber containing substrate.

19. The cargo assemblage of claim 17, wherein the rolled paper product comprises a roll density greater than or equal to about 0.03 g/cm$^3$ and less than or equal to about 0.32 g/cm$^3$.

20. The cargo assemblage of claim 17, wherein the rolled paper product has a roll diameter from about 6 inches to about 14 inches.

21. A cargo assemblage comprising:

a pallet comprising a first perimeter;

a load comprising a bottom surface and a top surface, the bottom surface comprising a second perimeter, wherein the second perimeter is asymmetrical, wherein the bottom surface is positioned on the pallet, the load comprising containers of absorbent paper product, the containers arranged in stacked layers from a bottom layer of containers to a top layer of containers;

a film connecting the load with the pallet and connecting neighboring stacked layers together, the film comprising a wrap profile, the wrap profile comprising first layers of film that connect the bottom layer of containers with the pallet and second layers of film that connect neighboring stacked layers together, wherein the film is wrapped around the bottom layer of containers with a bottom containment force, and wherein the film is wrapped around the top layer of containers with a top containment force; and wherein the bottom containment force is different than the top containment force.

22. A cargo assemblage comprising:

a pallet comprising a first perimeter;

a load comprising a bottom surface and a top surface, the bottom surface comprising a second perimeter, the load comprising containers of absorbent paper product, the containers arranged in stacked layers from a bottom layer of containers to a top layer of containers;

wherein the load is at least partially underhung and is at least partially overhung;

a film connecting the load with the pallet and connecting neighboring stacked layers together, the film comprising a wrap profile, the wrap profile comprising first layers of film that connect the bottom layer of containers with the pallet and second layers of film that connect neighboring stacked layers together, wherein the film is wrapped around the bottom layer of containers with a bottom containment force, and wherein the film is wrapped around the top layer of containers with a top containment force; and wherein the bottom containment force is different than the top containment force.

* * * * *